US011850563B2

(12) United States Patent
Oehring et al.

(10) Patent No.: US 11,850,563 B2
(45) **Date of Patent: *Dec. 26, 2023**

(54) INDEPENDENT CONTROL OF AUGER AND HOPPER ASSEMBLY IN ELECTRIC BLENDER SYSTEM

(71) Applicant: U.S. Well Services, Inc., Houston, TX (US)

(72) Inventors: Jared Oehring, Houston, TX (US); Brandon N. Hinderliter, Houston, TX (US)

(73) Assignee: U.S. Well Services, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/356,263

(22) Filed: Mar. 18, 2019

(65) Prior Publication Data

US 2020/0047141 A1 Feb. 13, 2020

Related U.S. Application Data

(63) Continuation of application No. 15/294,349, filed on Oct. 14, 2016, now Pat. No. 10,232,332.

(51) Int. Cl.
*B01F 35/71* (2022.01)
*E21B 43/267* (2006.01)
(Continued)

(52) U.S. Cl.
CPC .... *B01F 35/71731* (2022.01); *B01F 35/3204* (2022.01); *B01F 35/32025* (2022.01);
(Continued)

(58) Field of Classification Search
CPC .. E04G 21/04; B28C 7/00; B28C 7/02; B28C 5/0875; B28C 9/04; B28C 7/0454;
(Continued)

(56) References Cited

U.S. PATENT DOCUMENTS 1,541,601 A 6/1925 Tribe
1,656,861 A 1/1928 Leonard
(Continued)

FOREIGN PATENT DOCUMENTS

AU 2007340913 7/2008
CA 2406801 11/2001
(Continued)

OTHER PUBLICATIONS

Non-Final Office Action issued in U.S. Appl. No. 14/881,535 dated May 20, 2020.
(Continued)

*Primary Examiner* — Charles Cooley
(74) *Attorney, Agent, or Firm* — HOGAN LOVELLS US LLP

(57) ABSTRACT

Embodiments relate to a hydraulic fracturing system that includes a blender unit. The system includes an auger and hopper assembly to receive proppant from a proppant source and feed the proppant to the blender unit for mixing with a fluid. A first power source is used to power the blender unit in order to mix the proppant with the fluid and prepare a fracturing slurry. A second power source independently powers the auger and hopper assembly in order to align the hopper of the auger and hopper assembly with a proppant feed from the proppant source. Thus, the auger and hopper assembly can be stowed or deployed without use of the first power source, which is the main power supply to the blender unit.

8 Claims, 7 Drawing Sheets

(51) Int. Cl.

| | |
|---|---|
| ***B28C 9/04*** | (2006.01) |
| ***B28C 7/04*** | (2006.01) |
| ***B28C 7/10*** | (2006.01) |
| ***F04B 17/03*** | (2006.01) |
| ***F04B 19/22*** | (2006.01) |
| ***F04B 49/20*** | (2006.01) |
| ***F04B 17/06*** | (2006.01) |
| ***F04B 23/00*** | (2006.01) |
| ***F04B 47/02*** | (2006.01) |
| ***F04B 49/06*** | (2006.01) |
| ***B01F 35/32*** | (2022.01) |
| ***E21B 43/02*** | (2006.01) |
| ***B01F 101/49*** | (2022.01) |
| ***E21B 43/26*** | (2006.01) |

(52) U.S. Cl.

CPC ..... *B28C 7/0477* (2013.01); *B28C 7/10* (2013.01); *B28C 9/04* (2013.01); *E21B 43/267* (2013.01); *E21B 43/2607* (2020.05); *F04B 17/03* (2013.01); *F04B 17/06* (2013.01); *F04B 19/22* (2013.01); *F04B 23/00* (2013.01); *F04B 47/02* (2013.01); *F04B 49/065* (2013.01); *F04B 49/20* (2013.01); *B01F 2101/49* (2022.01)

(58) Field of Classification Search

CPC ..... B28C 7/044; B28C 9/0454; B28C 7/0418; B28C 7/0422; B28C 7/0477; B28C 7/10; B01F 15/0235; B01F 15/00538; B01F 15/00519; B01F 2215/0081; B01F 35/71731; B01F 35/32025; B01F 35/3204; B01F 2101/49; F01D 15/08; F01D 15/10; F02C 3/22; F04B 49/20; F04B 19/22; F04B 17/03; F04B 17/06; F04B 23/00; F04B 47/02; F04B 49/065; H02P 23/00; E21B 43/267; E21B 43/26

USPC .... 366/14–20, 27–29, 33–35, 64–66, 37–38, 366/31–32, 50–51, 41

See application file for complete search history.

(56) References Cited

U.S. PATENT DOCUMENTS 1,671,436 A 5/1928 Melott
1,743,771 A 1/1930 Hall
1,967,466 A 7/1934 Damsel
2,004,077 A 6/1935 McCartney
2,183,364 A 12/1939 Bailey
2,220,622 A 11/1940 Aitken
2,244,106 A 6/1941 Granberg
2,248,051 A 7/1941 Armstrong
2,407,796 A 9/1946 Page
2,416,848 A 3/1947 Rothery
2,610,741 A 9/1952 Schmid
2,753,940 A 7/1956 Bonner
2,976,025 A * 3/1961 Pro ..... B28C 9/0427 366/20
3,055,682 A 9/1962 Bacher
3,061,039 A 10/1962 Peters
3,066,503 A 12/1962 Fleming
3,302,069 A 1/1967 Webster
3,334,495 A 8/1967 Jensen
3,347,570 A 10/1967 Roessler
3,722,595 A 3/1973 Kiel
3,764,233 A 10/1973 Strickland
3,773,140 A 11/1973 Mahajan
3,837,179 A 9/1974 Barth
3,849,662 A 11/1974 Blaskowski
3,878,884 A 4/1975 Raleigh
3,881,551 A 5/1975 Terry
3,967,841 A 7/1976 Kendrick
4,037,431 A 7/1977 Sugimoto
4,100,822 A 7/1978 Rosman
4,151,575 A 4/1979 Hogue
4,226,299 A 10/1980 Hansen
4,265,266 A 5/1981 Kierbow et al.
4,432,064 A 2/1984 Barker
4,442,665 A 4/1984 Fick
4,456,092 A 6/1984 Kubozuka
4,506,982 A * 3/1985 Smithers ..... B01F 7/00641 366/142
4,512,387 A 4/1985 Rodriguez
4,529,887 A 7/1985 Johnson
4,538,916 A * 9/1985 Zimmerman ..... B28C 9/0463 366/186
4,601,629 A * 7/1986 Zimmerman ..... B28C 9/0463 198/735.3
4,676,063 A 6/1987 Goebel et al.
4,759,674 A 7/1988 Schroder
4,768,884 A * 9/1988 Elkin ..... B29B 9/04 366/28
4,783,038 A 11/1988 Gilbert
4,793,386 A 12/1988 Sloan
4,845,981 A 7/1989 Pearson
4,922,463 A * 5/1990 Del Zotto ..... B28C 9/0463 222/189.06
5,004,400 A 4/1991 Handke
5,006,044 A 4/1991 Walker, Sr.
5,025,861 A 6/1991 Huber
5,050,673 A 9/1991 Baldridge
5,114,239 A 5/1992 Allen
5,130,628 A 7/1992 Owen
5,131,472 A 7/1992 Dees et al.
5,172,009 A 12/1992 Mohan
5,189,388 A 2/1993 Mosley
5,230,366 A 7/1993 Marandi
5,293,947 A 3/1994 Stratton
5,334,899 A 8/1994 Skybyk
5,366,324 A 11/1994 Arlt
5,422,550 A 6/1995 McClanahan
5,433,243 A 7/1995 Griswold
5,439,066 A 8/1995 Gipson
5,486,047 A * 1/1996 Zimmerman ..... B01F 7/08 198/860.3
5,517,822 A 5/1996 Haws et al.
5,548,093 A 8/1996 Sato
5,549,285 A 8/1996 Collins
5,590,976 A * 1/1997 Kilheffer ..... E01C 19/46 177/119
5,606,853 A 3/1997 Birch
5,655,361 A 8/1997 Kishi
5,736,838 A 4/1998 Dove et al.
5,755,096 A 5/1998 Holleyman
5,790,972 A 8/1998 Kohlenberger
5,791,636 A 8/1998 Loziuk
5,798,596 A 8/1998 Lordo
5,865,247 A 2/1999 Paterson
5,879,137 A 3/1999 Yie
5,894,888 A 4/1999 Wiemers
5,907,970 A 6/1999 Havlovick et al.
5,950,726 A 9/1999 Roberts
6,035,265 A 3/2000 Dister et al.
6,097,310 A 8/2000 Harrell et al.
6,116,040 A 9/2000 Stark
6,121,705 A 9/2000 Hoong
6,138,764 A 10/2000 Scarsdale et al.
6,142,878 A 11/2000 Barin
6,164,910 A 12/2000 Mayleben
6,202,702 B1 3/2001 Ohira
6,208,098 B1 3/2001 Kume
6,254,462 B1 7/2001 Kelton
6,271,637 B1 8/2001 Kushion
6,273,193 B1 8/2001 Hermann
6,315,523 B1 11/2001 Mills
6,406,011 B1 6/2002 Kosar
6,477,852 B2 11/2002 Dodo
6,484,490 B1 11/2002 Olsen
6,491,098 B1 12/2002 Dallas
6,510,695 B1 1/2003 Fisher

(56) References Cited

U.S. PATENT DOCUMENTS 6,529,135 B1 3/2003 Bowers et al.
6,626,646 B2 9/2003 Rajewski
6,719,900 B2 4/2004 Hawkins
6,765,304 B2 7/2004 Baten et al.
6,776,227 B2 8/2004 Beida
6,788,022 B2 9/2004 Sopko
6,802,690 B2 10/2004 Han
6,808,303 B2 * 10/2004 Fisher ..... B28C 5/1246 366/26
6,837,910 B1 1/2005 Yoshikawa
6,931,310 B2 8/2005 Shimizu et al.
6,936,947 B1 8/2005 Leijon
6,985,750 B1 1/2006 Vicknair et al.
7,082,993 B2 8/2006 Ayoub
7,104,233 B2 9/2006 Ryczek et al.
7,170,262 B2 1/2007 Pettigrew
7,173,399 B2 2/2007 Sihler
7,279,655 B2 10/2007 Blutke
7,308,933 B1 12/2007 Mayfield
7,309,835 B2 12/2007 Morrison
7,312,593 B1 12/2007 Streicher et al.
7,336,514 B2 2/2008 Amarillas
7,341,287 B2 3/2008 Gibb
7,445,041 B2 11/2008 O'Brien
7,494,263 B2 2/2009 Dykstra
7,500,642 B2 3/2009 Cunningham
7,525,264 B2 4/2009 Dodge
7,563,076 B2 7/2009 Brunet
7,581,379 B2 9/2009 Yoshida
7,675,189 B2 3/2010 Grenier
7,683,499 B2 3/2010 Saucier
7,717,193 B2 5/2010 Egilsson
7,755,310 B2 7/2010 West et al.
7,770,396 B2 8/2010 Roby
7,795,830 B2 9/2010 Johnson
7,807,048 B2 10/2010 Collette
7,835,140 B2 11/2010 Mori
7,845,413 B2 12/2010 Shampine
7,900,893 B2 3/2011 Teurlay
7,926,562 B2 4/2011 Poitzsch
7,940,039 B2 5/2011 de Buda
7,894,757 B2 7/2011 Keast
7,977,824 B2 7/2011 Halen et al.
8,037,936 B2 10/2011 Neuroth
8,054,084 B2 11/2011 Schulz et al.
8,083,504 B2 12/2011 Williams
8,091,928 B2 1/2012 Carrier
8,096,354 B2 1/2012 Poitzsch
8,096,891 B2 1/2012 Lochtefeld
8,139,383 B2 3/2012 Efraimsson
8,146,665 B2 4/2012 Neal
8,154,419 B2 4/2012 Daussin et al.
8,221,513 B2 7/2012 Ariyapadi
8,232,892 B2 7/2012 Overholt et al.
8,261,528 B2 9/2012 Chillar
8,272,439 B2 9/2012 Strickland
8,310,272 B2 11/2012 Quarto
8,354,817 B2 1/2013 Yeh et al.
8,474,521 B2 7/2013 Kajaria
RE44,444 E 8/2013 Dole
8,506,267 B2 8/2013 Gambier et al.
8,534,235 B2 9/2013 Chandler
8,556,302 B2 10/2013 Dole
8,573,303 B2 11/2013 Kerfoot
8,596,056 B2 12/2013 Woodmansee
8,616,005 B1 12/2013 Cousino
8,616,274 B2 12/2013 Belcher
8,646,521 B2 2/2014 Bowen
8,692,408 B2 4/2014 Zhang et al.
8,727,068 B2 5/2014 Bruin
8,760,657 B2 6/2014 Pope
8,763,387 B2 7/2014 Schmidt
8,774,972 B2 7/2014 Rusnak
8,789,601 B2 7/2014 Broussard
8,795,525 B2 8/2014 McGinnis et al.
8,800,652 B2 8/2014 Bartko
8,807,960 B2 8/2014 Stephenson
8,838,341 B2 9/2014 Kumano
8,851,860 B1 10/2014 Mail
8,857,506 B2 10/2014 Stone, Jr.
8,899,940 B2 12/2014 Laugemors
8,905,056 B2 12/2014 Kendrick
8,905,138 B2 12/2014 Undstedt et al.
8,997,904 B2 4/2015 Cryer
9,018,881 B2 4/2015 Mao et al.
9,051,822 B2 6/2015 Ayan
9,051,923 B2 6/2015 Kuo
9,061,223 B2 6/2015 Winborn
9,062,545 B2 6/2015 Roberts et al.
9,067,182 B2 6/2015 Nichols
9,103,193 B2 8/2015 Coli
9,119,326 B2 8/2015 McDonnell
9,121,257 B2 9/2015 Coli et al.
9,140,110 B2 9/2015 Coli et al.
9,160,168 B2 10/2015 Chapel
9,175,554 B1 11/2015 Watson
9,206,684 B2 12/2015 Parra
9,260,253 B2 2/2016 Naizer
9,322,239 B2 4/2016 Angeles Boza et al.
9,324,049 B2 4/2016 Thomeer
9,340,353 B2 5/2016 Oren
9,366,114 B2 6/2016 Coli et al.
9,410,410 B2 8/2016 Broussard
9,450,385 B2 9/2016 Kristensen
9,458,687 B2 10/2016 Hallundbaek
9,475,020 B2 10/2016 Coli et al.
9,475,021 B2 10/2016 Coli et al.
9,482,086 B2 11/2016 Richardson et al.
9,499,335 B2 11/2016 McIver
9,506,333 B2 11/2016 Castillo et al.
9,513,055 B1 12/2016 Seal
9,534,473 B2 1/2017 Morris
9,562,420 B2 2/2017 Morris et al.
9,587,649 B2 * 3/2017 Oehring ..... F04D 29/5806
9,611,728 B2 4/2017 Oehring
9,650,871 B2 5/2017 Oehring et al.
9,650,879 B2 5/2017 Broussard et al.
9,706,185 B2 7/2017 Ellis
9,728,354 B2 8/2017 Skolozdra
9,738,461 B2 8/2017 DeGaray
9,739,546 B2 8/2017 Bertilsson et al.
9,745,840 B2 8/2017 Oehring
9,840,901 B2 12/2017 Oehring
9,863,228 B2 1/2018 Shampine et al.
9,893,500 B2 2/2018 Oehring
9,903,190 B2 2/2018 Conrad
9,909,398 B2 3/2018 Pham
9,915,128 B2 3/2018 Hunter
9,932,799 B2 4/2018 Symchuk
9,963,961 B2 5/2018 Hardin
9,970,278 B2 5/2018 Broussard
9,976,351 B2 5/2018 Randall
9,995,218 B2 6/2018 Oehring
10,008,880 B2 6/2018 Vicknair
10,020,711 B2 7/2018 Oehring
10,036,238 B2 7/2018 Oehring
10,107,086 B2 10/2018 Oehring
10,119,381 B2 11/2018 Oehring
10,184,465 B2 1/2019 Enis et al.
10,196,878 B2 2/2019 Hunter
10,221,639 B2 3/2019 Romer et al.
10,227,854 B2 3/2019 Glass
10,232,332 B2 * 3/2019 Oehring ..... B28C 7/0477
10,246,984 B2 4/2019 Payne
10,254,732 B2 4/2019 Oehring
10,260,327 B2 4/2019 Kajaria
10,280,724 B2 5/2019 Hinderliter
10,287,873 B2 5/2019 Filas
10,302,079 B2 5/2019 Kendrick
10,309,205 B2 6/2019 Randall
10,337,308 B2 7/2019 Broussard
10,371,012 B2 8/2019 Davis
10,378,326 B2 8/2019 Morris
10,393,108 B2 8/2019 Chong

(56) References Cited

U.S. PATENT DOCUMENTS 10,407,990 B2 9/2019 Oehring
10,408,030 B2 9/2019 Oehring
10,408,031 B2 9/2019 Oehring
10,415,332 B2 9/2019 Morris et al.
10,436,026 B2 10/2019 Ounadjela
10,526,882 B2 1/2020 Oehring
10,627,003 B2 4/2020 Dale et al.
10,648,311 B2 5/2020 Oehring
10,669,471 B2 6/2020 Schmidt et al.
10,669,804 B2 6/2020 Kotrla
10,690,131 B2 6/2020 Rashid
10,695,950 B2 * 6/2020 Igo ..... B28C 7/02
10,711,576 B2 7/2020 Bishop
10,740,730 B2 8/2020 Altamirano et al.
10,794,165 B2 10/2020 Fischer et al.
10,934,824 B2 3/2021 Oehring
11,091,992 B2 8/2021 Broussard
2001/0000996 A1 5/2001 Grimland et al.
2002/0169523 A1 11/2002 Ross et al.
2003/0056514 A1 3/2003 Lohn
2003/0057704 A1 3/2003 Baten
2003/0079875 A1 5/2003 Weng
2003/0138327 A1 7/2003 Jones et al.
2004/0040746 A1 3/2004 Niedermayr et al.
2004/0102109 A1 5/2004 Cratty et al.
2004/0167738 A1 8/2004 Miller
2005/0061548 A1 3/2005 Hooper
2005/0116541 A1 6/2005 Seiver
2005/0201197 A1 9/2005 Duell et al.
2005/0274508 A1 12/2005 Folk
2006/0052903 A1 3/2006 Bassett
2006/0065319 A1 3/2006 Csitari
2006/0109141 A1 5/2006 Huang
2006/0260331 A1 11/2006 Andreychuk
2007/0125544 A1 6/2007 Robinson
2007/0131410 A1 6/2007 Hill
2007/0187163 A1 8/2007 Cone
2007/0201305 A1 8/2007 Heilman
2007/0226089 A1 * 9/2007 DeGaray ..... B28C 7/02
705/28
2007/0277982 A1 12/2007 Shampine
2007/0278140 A1 12/2007 Mallet et al.
2008/0017369 A1 1/2008 Sarada
2008/0041596 A1 2/2008 Blount
2008/0095644 A1 4/2008 Mantei et al.
2008/0112802 A1 5/2008 Orlando
2008/0137266 A1 6/2008 Jensen
2008/0164023 A1 7/2008 Dykstra et al.
2008/0208478 A1 8/2008 Ella et al.
2008/0217024 A1 9/2008 Moore
2008/0236818 A1 10/2008 Dykstra
2008/0257449 A1 10/2008 Weinstein et al.
2008/0264625 A1 10/2008 Ochoa
2008/0264640 A1 10/2008 Eslinger
2008/0264649 A1 10/2008 Crawford
2008/0277120 A1 11/2008 Hickie
2008/0288115 A1 11/2008 Rusnak
2009/0045782 A1 2/2009 Datta
2009/0065299 A1 3/2009 Vito
2009/0068031 A1 3/2009 Gambier
2009/0068301 A1 3/2009 Gambier
2009/0072645 A1 3/2009 Quere
2009/0078410 A1 3/2009 Krenek
2009/0090504 A1 4/2009 Weightman
2009/0093317 A1 4/2009 Kajiwara et al.
2009/0095482 A1 4/2009 Surjaatmadja
2009/0114392 A1 5/2009 Tolman
2009/0145611 A1 6/2009 Pallini, Jr.
2009/0153354 A1 6/2009 Daussin
2009/0188181 A1 7/2009 Forbis
2009/0200035 A1 8/2009 Bjerkreim et al.
2009/0260826 A1 10/2009 Sherwood
2009/0308602 A1 12/2009 Bruins
2009/0315297 A1 12/2009 Nadeau
2010/0000508 A1 1/2010 Chandler
2010/0019574 A1 1/2010 Baldassarre et al.
2010/0038907 A1 2/2010 Hunt
2010/0045109 A1 2/2010 Arnold
2010/0051272 A1 3/2010 Loree et al.
2010/0101785 A1 4/2010 Khvoshchev
2010/0132949 A1 6/2010 DeFosse et al.
2010/0146981 A1 6/2010 Motakef
2010/0172202 A1 7/2010 Borgstadt
2010/0193057 A1 8/2010 Garner
2010/0200224 A1 8/2010 Nguete
2010/0250139 A1 9/2010 Hobbs
2010/0281876 A1 11/2010 Khan
2010/0293973 A1 11/2010 Erickson
2010/0303655 A1 12/2010 Scekic
2010/0322802 A1 12/2010 Kugelev
2011/0005757 A1 1/2011 Hebert
2011/0017468 A1 1/2011 Birch et al.
2011/0052423 A1 3/2011 Gambier
2011/0061855 A1 3/2011 Case
2011/0081268 A1 4/2011 Ochoa et al.
2011/0085924 A1 4/2011 Shampine
2011/0110793 A1 5/2011 Leugemores et al.
2011/0166046 A1 7/2011 Weaver
2011/0175397 A1 7/2011 Amrine
2011/0197988 A1 8/2011 Van Vliet
2011/0241590 A1 10/2011 Horikoshi
2011/0247878 A1 10/2011 Rasheed
2011/0272158 A1 11/2011 Neal
2012/0018016 A1 1/2012 Gibson
2012/0049625 A1 3/2012 Hopwood
2012/0063936 A1 3/2012 Baxter et al.
2012/0085541 A1 4/2012 Love et al.
2012/0112757 A1 5/2012 Vrankovic
2012/0127635 A1 5/2012 Grindeland
2012/0150455 A1 6/2012 Franklin et al.
2012/0152716 A1 6/2012 Kikukawa et al.
2012/0205301 A1 8/2012 McGuire et al.
2012/0205400 A1 * 8/2012 DeGaray ..... B28C 5/0875
222/192
2012/0222865 A1 9/2012 Arson
2012/0232728 A1 9/2012 Karimi et al.
2012/0247783 A1 10/2012 Bemer, Jr.
2012/0255734 A1 10/2012 Coli
2013/0009469 A1 1/2013 Gillett
2013/0025706 A1 * 1/2013 DeGaray ..... B28C 7/0418
137/351
2013/0078114 A1 3/2013 Van Rijswick
2013/0138254 A1 5/2013 Seals
2013/0175038 A1 7/2013 Conrad
2013/0175039 A1 7/2013 Guidry
2013/0180722 A1 7/2013 Olarte Caro
2013/0189629 A1 7/2013 Chandler
2013/0199617 A1 * 8/2013 DeGaray ..... B65G 53/40
137/1
2013/0233542 A1 9/2013 Shampine
2013/0255271 A1 10/2013 Yu et al.
2013/0284278 A1 10/2013 Winborn
2013/0284455 A1 10/2013 Kajaria et al.
2013/0299167 A1 11/2013 Fordyce
2013/0306322 A1 11/2013 Sanborn
2013/0317750 A1 11/2013 Hunter
2013/0341029 A1 12/2013 Roberts et al.
2013/0343858 A1 12/2013 Flusche
2014/0000899 A1 1/2014 Nevison
2014/0010671 A1 1/2014 Cryer et al.
2014/0054965 A1 2/2014 Jain
2014/0060658 A1 3/2014 Hains
2014/0077607 A1 3/2014 Clarke
2014/0095114 A1 4/2014 Thomeer
2014/0096974 A1 4/2014 Coli
2014/0124162 A1 5/2014 Eavitt
2014/0138079 A1 5/2014 Broussard
2014/0174717 A1 6/2014 Broussard
2014/0219824 A1 8/2014 Burnette
2014/0238683 A1 8/2014 Korach
2014/0246211 A1 9/2014 Guidry et al.
2014/0251623 A1 9/2014 Lestz et al.
2014/0255214 A1 9/2014 Burnette
2014/0277772 A1 9/2014 Lopez

(56) References Cited

U.S. PATENT DOCUMENTS

2014/0290768 A1 10/2014 Randle
2014/0294603 A1 10/2014 Best
2014/0379300 A1 12/2014 Devine et al.
2015/0027712 A1 1/2015 Vicknair
2015/0053426 A1 2/2015 Smith
2015/0068724 A1 3/2015 Coli et al.
2015/0068754 A1 3/2015 Coli et al.
2015/0075778 A1 3/2015 Walters
2015/0083426 A1 3/2015 Esko
2015/0097504 A1 4/2015 Lamascus
2015/0114652 A1 4/2015 Estz
2015/0136043 A1 5/2015 Shaaban
2015/0144336 A1 5/2015 Hardin
2015/0147194 A1 5/2015 Foote
2015/0159911 A1 6/2015 Holt
2015/0175013 A1 6/2015 Cryer et al.
2015/0176386 A1 6/2015 Castillo et al.
2015/0211512 A1 7/2015 Wiegman
2015/0211524 A1 7/2015 Broussard
2015/0217672 A1 8/2015 Shampine
2015/0225113 A1 8/2015 Lungu
2015/0233530 A1 8/2015 Sandidge
2015/0252661 A1 9/2015 Glass
2015/0300145 A1 10/2015 Coli et al.
2015/0300336 A1 10/2015 Hernandez et al.
2015/0314225 A1 11/2015 Coli et al.
2015/0330172 A1 11/2015 Allmaras
2015/0354322 A1 12/2015 Vicknair
2016/0006311 A1 1/2016 Li
2016/0032703 A1* 2/2016 Broussard ..... E21B 43/267
166/250.01
2016/0102537 A1 4/2016 Lopez
2016/0105022 A1 4/2016 Oehring
2016/0160889 A1 6/2016 Hoffman et al.
2016/0177675 A1 6/2016 Morris et al.
2016/0177678 A1 6/2016 Morris
2016/0186531 A1 6/2016 Harkless et al.
2016/0208592 A1* 7/2016 Oehring ..... H02K 9/04
2016/0208593 A1 7/2016 Coli et al.
2016/0208594 A1 7/2016 Coli et al.
2016/0208595 A1 7/2016 Tang
2016/0221220 A1* 8/2016 Paige ..... B28C 9/0463
2016/0230524 A1 8/2016 Dumoit
2016/0230525 A1 8/2016 Lestz et al.
2016/0258267 A1 9/2016 Payne
2016/0265457 A1 9/2016 Stephenson
2016/0273328 A1* 9/2016 Oehring ..... E21B 43/26
2016/0273456 A1 9/2016 Zhang et al.
2016/0281484 A1 9/2016 Lestz
2016/0290114 A1* 10/2016 Oehring ..... E21B 43/26
2016/0290563 A1 10/2016 Diggins
2016/0312108 A1 10/2016 Lestz et al.
2016/0319650 A1* 11/2016 Oehring ..... E21B 43/267
2016/0326853 A1 11/2016 Fred et al.
2016/0326854 A1 11/2016 Broussard
2016/0326855 A1 11/2016 Coli et al.
2016/0341281 A1 11/2016 Brunvold et al.
2016/0348479 A1 12/2016 Oehring
2016/0349728 A1 12/2016 Oehring
2016/0369609 A1 12/2016 Morris et al.
2017/0016433 A1 1/2017 Chong
2017/0021318 A1 1/2017 McIver et al.
2017/0022788 A1* 1/2017 Oehring ..... F04B 49/103
2017/0022807 A1 1/2017 Dursun
2017/0028368 A1* 2/2017 Oehring ..... B28C 9/04
2017/0030177 A1* 2/2017 Oehring ..... E21B 7/026
2017/0030178 A1* 2/2017 Oehring ..... E21B 43/26
2017/0036178 A1 2/2017 Coli et al.
2017/0036872 A1 2/2017 Wallace
2017/0037717 A1 2/2017 Oehring
2017/0037718 A1 2/2017 Coli et al.
2017/0043280 A1 2/2017 Vankouwenberg
2017/0051732 A1 2/2017 Hemandez et al.
2017/0074076 A1 3/2017 Joseph et al.
2017/0082033 A1 3/2017 Wu et al.
2017/0096885 A1 4/2017 Oehring
2017/0096889 A1 4/2017 Blanckaert et al.
2017/0104389 A1 4/2017 Morris et al.
2017/0114625 A1 4/2017 Norris
2017/0130743 A1 5/2017 Anderson
2017/0138171 A1 5/2017 Richards et al.
2017/0145918 A1 5/2017 Oehring
2017/0146189 A1 5/2017 Herman
2017/0159570 A1 6/2017 Bickert
2017/0159654 A1 6/2017 Kendrick
2017/0175516 A1 6/2017 Eslinger
2017/0204852 A1 7/2017 Barnett
2017/0212535 A1 7/2017 Shelman et al.
2017/0218727 A1 8/2017 Oehring
2017/0218843 A1 8/2017 Oehring
2017/0222409 A1 8/2017 Oehring
2017/0226838 A1 8/2017 Ciezobka
2017/0226839 A1 8/2017 Broussard
2017/0226842 A1 8/2017 Omont
2017/0234250 A1 8/2017 Janik
2017/0241221 A1 8/2017 Seshadri
2017/0259227 A1 9/2017 Morris et al.
2017/0292513 A1 10/2017 Haddad
2017/0313499 A1 11/2017 Hughes et al.
2017/0314380 A1 11/2017 Oehring
2017/0314979 A1 11/2017 Ye et al.
2017/0328179 A1 11/2017 Dykstra
2017/0369258 A1 12/2017 DeGaray
2017/0370639 A1 12/2017 Barden et al.
2018/0028992 A1 2/2018 Stegemoeller
2018/0038216 A1 2/2018 Zhang
2018/0045331 A1 2/2018 Lopez
2018/0090914 A1 3/2018 Johnson et al.
2018/0156210 A1 6/2018 Oehring
2018/0181830 A1 6/2018 Luharuka et al.
2018/0183219 A1 6/2018 Oehring
2018/0216455 A1 8/2018 Andreychuk
2018/0238147 A1 8/2018 Shahri
2018/0245428 A1 8/2018 Richards
2018/0258746 A1 9/2018 Broussard
2018/0259080 A1 9/2018 Dale et al.
2018/0266217 A1 9/2018 Funkhauser et al.
2018/0266412 A1 9/2018 Stokkevag
2018/0274446 A1 9/2018 Oehring
2018/0284817 A1 10/2018 Cook et al.
2018/0291713 A1 10/2018 Jeanson
2018/0298731 A1 10/2018 Bishop
2018/0312738 A1 11/2018 Rutsch et al.
2018/0313677 A1 11/2018 Warren et al.
2018/0320483 A1 11/2018 Zhang
2018/0343125 A1 11/2018 Clish
2018/0363437 A1 12/2018 Coli
2018/0363640 A1 12/2018 Kajita et al.
2019/0003329 A1 1/2019 Morris
2019/0010793 A1 1/2019 Hinderliter
2019/0040727 A1 2/2019 Oehring et al.
2019/0063309 A1 2/2019 Davis
2019/0100989 A1 4/2019 Stewart
2019/0112910 A1 4/2019 Oehring
2019/0119096 A1 4/2019 Haile
2019/0120024 A1 4/2019 Oehring
2019/0128080 A1 5/2019 Ross
2019/0128104 A1 5/2019 Graham et al.
2019/0145251 A1 5/2019 Johnson
2019/0154020 A1 5/2019 Glass
2019/0162061 A1 5/2019 Stephenson
2019/0169971 A1 6/2019 Oehring
2019/0178057 A1 6/2019 Hunter
2019/0178235 A1 6/2019 Coskrey
2019/0203567 A1 7/2019 Ross
2019/0203572 A1 7/2019 Morris
2019/0211661 A1 7/2019 Reckels
2019/0226317 A1 7/2019 Payne
2019/0245348 A1 8/2019 Hinderliter
2019/0249527 A1 8/2019 Kraynek
2019/0257462 A1 8/2019 Rogers
2019/0292866 A1 9/2019 Ross
2019/0292891 A1 9/2019 Kajaria
2019/0316447 A1 10/2019 Oehring

(56) References Cited

U.S. PATENT DOCUMENTS

| | | | | |
|---|---|---|---|---|
| 2020/0047141 | A1* | 2/2020 | Oehring | B01F 15/0235 |
| 2020/0088152 | A1 | 3/2020 | Allion et al. | |
| 2020/0232454 | A1 | 7/2020 | Chretien | |
| 2021/0198994 | A1* | 7/2021 | Christinzio | B01F 35/71775 |
| 2022/0385074 | A1* | 12/2022 | Hinderliter | E21B 43/2607 |

FOREIGN PATENT DOCUMENTS

| | | | |
|---|---|---|---|
| CA | 2707269 | | 12/2010 |
| CA | 2482943 | | 5/2011 |
| CA | 3050131 | | 11/2011 |
| CA | 2955706 | | 10/2012 |
| CA | 2966672 | | 10/2012 |
| CA | 3000322 | | 4/2013 |
| CA | 2787814 | | 2/2014 |
| CA | 2833711 | | 5/2014 |
| CA | 2978706 | | 9/2016 |
| CA | 2944980 | | 2/2017 |
| CA | 3006422 | | 6/2017 |
| CA | 3018485 | | 8/2017 |
| CA | 2964593 | | 10/2017 |
| CA | 2849825 | | 7/2018 |
| CA | 3067854 | A1 | 1/2019 |
| CA | 2919649 | | 2/2019 |
| CA | 2919666 | | 7/2019 |
| CA | 2797081 | | 9/2019 |
| CA | 2945579 | | 10/2019 |
| CN | 201687513 | | 12/2010 |
| CN | 101977016 | | 2/2011 |
| CN | 202023547 | | 11/2011 |
| CN | 102602322 | | 7/2012 |
| CN | 104117308 | A | 10/2014 |
| CN | 104196613 | A | 12/2014 |
| CN | 205986303 | U | 2/2017 |
| CN | 108049999 | A | 5/2018 |
| CN | 112196508 | A | 1/2021 |
| JP | 2004264589 | | 9/2004 |
| WO | 00/47893 | | 8/2000 |
| WO | 2012/051705 | | 4/2012 |
| WO | 2014/116761 | | 7/2014 |
| WO | 2014/177346 | | 11/2014 |
| WO | 2016/144939 | | 9/2016 |
| WO | 2016/160458 | | 10/2016 |
| WO | 2018044307 | A1 | 3/2018 |
| WO | 2018213925 | A1 | 11/2018 |

OTHER PUBLICATIONS

Non-Final Office Action issued in U.S. Appl. No. 15/145,443 dated May 8, 2020.
Non-Final Office Action issued in U.S. Appl. No. 16/458,696 dated May 22, 2020.
International Search Report and Written Opinion issued in PCT/US2020/023809 dated Jun. 2, 2020.
Karin, "Duel Fuel Diesel Engines," (2015), Taylor & Francis, pp. 62-63, Retrieved from https://app.knovel.com/hotlink/toc/id:kpDFDE0001/dual-fueal-diesel-engines/duel-fuel-diesel-engines (Year 2015).
Goodwin, "High-voltage auxilliary switchgear for power stations," Power Engineering Journal, 1989, 10 pg. (Year 1989).
Final Office Action dated Mar. 31, 2020 corresponding to U.S. Appl. No. 15/356,436.
Non-Final Office Action dated Mar. 3, 2020 corresponding to U.S. Appl. No. 16/152,695.
JK Power Networks—Transformers to Supply Heat to Tate Modern—from Press Releases May 16, 2013.
Non-Final Office Action issued in corresponding U.S. Appl. No. 15/293,681 dated Feb. 16, 2017.
Non-Final Office Action issued in corresponding U.S. Appl. No. 15/294,349 dated Mar. 14, 2017.
Final Office Action issued in corresponding U.S. Appl. No. 15/145,491 dated Jan. 20, 2017.
Non-Final Office Action issued in corresponding U.S. Appl. No. 15/145,443 dated Feb. 7, 2017.
Notice of Allowance issued in corresponding U.S. Appl. No. 15/217,040 dated Mar. 28, 2017.
Notice of Allowance issued in corresponding U.S. Appl. No. 14/622,532 dated Mar. 27, 2017.
Non-Final Office Action issued in corresponding U.S. Appl. No. 15/291,842 dated Jan. 6, 2017.
Final Office Action issued in corresponding U.S. Appl. No. 14/622,532 dated Dec. 7, 2016.
Non-Final Office Action issued in corresponding U.S. Appl. No. 14/622,532 dated May 17, 2016.
Final Office Action issued in corresponding U.S. Appl. No. 14/622,532 dated Dec. 21, 2015.
Non-Final Office Action issued in corresponding U.S. Appl. No. 14/622,532 dated Aug. 5, 2015.
Non-Final Office Action issued in corresponding U.S. Appl. No. 15/145,491 on Sep. 12, 2016.
Non-Final Office Action issued in corresponding U.S. Appl. No. 15/217,040 dated Nov. 29, 2016.
Non-Final Office Action issued in corresponding U.S. Appl. No. 15/235,788 dated Dec. 14, 2016.
Non-Final Office Action issued in corresponding U.S. Appl. No. 15/145,491 dated May 15, 2017.
Non-Final Office Action issued in corresponding U.S. Appl. No. 15/486,970 dated Jun. 22, 2017.
Non-Final Office Action issued in corresponding U.S. Appl. No. 15/487,656 dated Jun. 23, 2017.
Non-Final Office Action issued in corresponding U.S. Appl. No. 15/487,694 dated Jun. 26, 2017.
Final Office Action issued in corresponding U.S. Appl. No. 15/294,349 dated Jul. 6, 2017.
Non-Final Office Action issued in corresponding U.S. Appl. No. 14/884,363 dated Sep. 5, 2017.
Final Office Action issued in corresponding U.S. Appl. No. 15/145,491 dated Sep. 6, 2017.
Non-Final Office Action issued in corresponding U.S. Appl. No. 14/881,535 dated Oct. 6, 2017.
Non-Final Office Action issued in corresponding U.S. Appl. No. 15/145,414 dated Nov. 29, 2017.
Non-Final Office Action issued in corresponding U.S. Appl. No. 15/644,487 dated Nov. 13, 2017.
Canadian Office Action dated Mar. 2, 2018 in related Canadian Patent Application No. 2,833,711.
Office Action dated Apr. 10, 2018 in related U.S. Appl. No. 15/294,349.
Office Action dated Apr. 2, 2018 in related U.S. Appl. No. 15/183,387.
Office Action dated May 29, 2018 in related U.S. Appl. No. 15/235,716.
Candian Office Action dated Apr. 18, 2018 in related Canadian Patent Application No. 2,928,711.
Canadian Office Action dated Jun. 22, 2018 in related Canadian Patent Application No. 2,886,697.
Office Action dated Jul. 25, 2018 in related U.S. Appl. No. 15/644,487.
Office Action dated Oct. 4, 2018 in related U.S. Appl. No. 15/217,081.
International Search Report and Written Opinion dated Sep. 19, 2018 in related PCT Patent Application No. PCT/US2018/040683.
Canadian Office Action dated Sep. 28, 2018 in related Canadian Patent Application No. 2,945,281.
Office Action dated Dec. 12, 2018 in related U.S. Appl. No. 16/160,708.
International Search Report and Written Opinion dated Jan. 2, 2019 in related PCT Patent Application No. PCT/US18/54542.
International Search Report and Written Opinion dated Jan. 2, 2019 in related PCT Patent Application No. PCT/US18/54548.
International Search Report and Written Opinion dated Dec. 31, 2018 in related PCT Patent Application No. PCT/US18/55913.
International Search Report and Written Opinion dated Jan. 4, 2019 in related PCT Patent Application No. PCT/US18/57539.
Non-Final Office Action dated Feb. 12, 2019 in related U.S. Appl. No. 16/170,695.
International Search Report and Written Opinion dated Feb. 15, 2019 in related PCT Patent Application No. PCT/US18/63977.

(56) References Cited

OTHER PUBLICATIONS

International Search Report and Written Opinion dated Mar. 5, 2019 in related PCT Patent Application No. PCT/US18/63970.
Non-Final Office Action dated Feb. 25, 2019 in related U.S. Appl. No. 16/210,749.
Non-Final Office Action dated Mar. 6, 2019 in related U.S. Appl. No. 15/183,387.
Office Action dated Jan. 30, 2019 in related Canadian Patent Application No. 2,936,997.
Office Action dated Mar. 1, 2019 in related Canadian Patent Application No. 2,943,275.
International Search Report and Written Opinion dated Apr. 10, 2019 in corresponding PCT Application No. PCT/US2019/016635.
Notice of Allowance dated Apr. 23, 2019 in corresponding U.S. Appl. No. 15/635,028.
International Search Report and Written Opinion dated Jan. 2, 2020 in related PCT Application No. PCT/US19/55325.
Notice of Allowance dated Jan. 9, 2020 in related U.S. Appl. No. 16/570,331.
Non-Final Office Action dated Dec. 23, 2019 in related U.S. Appl. No. 16/597,008.
Non-Final Office Action dated Jan. 10, 2020 in related U.S. Appl. No. 16/597,014.
Non-Final Office Action dated Dec. 6, 2019 in related U.S. Appl. No. 16/564,186.
International Search Report and Written Opinion dated Nov. 26, 2019 in related PCT Application No. PCT/US19/51018.
International Search Report and Written Opinion dated Feb. 11, 2020 in related PCT Application No. PCT/US2019/055323.
Schlumberger, "Jet Manual 23, Fracturing Pump Units, SPF/SPS-343, Version 1.0," Jan. 31, 2007, 68 pages.
Stewart & Stevenson, "Stimulation Systems," 2007, 20 pages.
Luis Gamboa, "Variable Frequency Drives in Oil and Gas Pumping Systems," Dec. 17, 2011, 5 pages.
"Griswold Model 811 Pumps: Installation, Operation and Maintenance Manual, ANSI Process Pump," 2010, 60 pages.
International Search Report and Written Opinion dated Jul. 9, 2019 in corresponding PCT Application No. PCT/US2019/027584.
Office Action dated Jun. 11, 2019 in corresponding U.S. Appl. No. 16/210,749.
Office Action dated May 10, 2019 in corresponding U.S. Appl. No. 16/268,030.
Canadian Office Action dated May 30, 2019 in corresponding CA Application No. 2,833,711.
Canadian Office Action dated Jun. 20, 2019 in corresponding CA Application No. 2,964,597.
Office Action dated Jun. 7, 2019 in corresponding U.S. Appl. No. 16/268,030.
International Search Report and Written Opinion dated Sep. 11, 2019 in related PCT Application No. PCT/US2019/037493.
Office Action dated Aug. 19, 2019 in related U.S. Appl. No. 15/356,436.
Office Action dated Oct. 2, 2019 in related U.S. Appl. No. 16/152,732.
Office Action dated Sep. 11, 2019 in related U.S. Appl. No. 16/268,030.
Office Action dated Oct. 11, 2019 in related U.S. Appl. No. 16/385,070.
Office Action dated Sep. 3, 2019 in related U.S. Appl. No. 15/994,772.
Office Action dated Sep. 20, 2019 in related U.S. Appl. No. 16/443,273.
Canadian Office Action dated Oct. 1, 2019 in related Canadian Patent Application No. 2,936,997.
Non-Final Office dated Oct. 26, 2020 in U.S. Appl. No. 15/356,436.
Non-Final Office dated Oct. 5, 2020 in U.S. Appl. No. 16/443,273.
Non-Final Office Action dated Sep. 29, 2020 in U.S. Appl. No. 16/943,727.
Non-Final Office Action dated Sep. 2, 2020 in U.S. Appl. No. 16/356,263.
Non-Final Office Action dated Aug. 31, 2020 in U.S. Appl. No. 16/167,083.
Albone, "Mobile Compressor Stations for Natural Gas Transmission Service," ASME 67-GT-33, Turbo Expo, Power for Land, Sea and Air, vol. 79887, p. 1-10, 1967.
Canadian Office Action dated Sep. 22, 2020 in Canadian Application No. 2,982,974.
International Search Report and Written Opinion dated Sep. 3, 2020 in PCT/US2020/36932.
"Process Burner" (https://www.cebasrt.com/productsloii-gaslprocess-bumer) Sep. 6, 2018 (Sep. 6, 2018), entire document, especially para (Burners for refinery Heaters].
Water and Glycol Heating Systems~ (https://www.heat-inc.com/wg-series-water-glycol-systems/) Jun. 18, 2018 (Jun. 18, 2018), entire document, especially WG Series Water Glycol Systems.
"Heat Exchanger" (https://en.wikipedia.org/w/index.php?title=Heat_exchanger&oldid=89300146) Dec. 18, 2019 Apr. 2019 (Apr. 18, 2019), entire document, especially para (0001].
Canadian Office Action dated Sep. 8, 2020 in Canadian Patent Application No. 2,928,707.
Canadian Office Action dated Aug. 31, 2020 in Canadian Patent Application No. 2,944,980.
International Search Report and Written Opinion dated Aug. 28, 2020 in PCT/US20/23821.
International Search Report and Written Opinion mailed in PCT/US20/67526 dated May 6, 2021.
International Search Report and Written Opinion mailed in PCT/US20/67608 dated Mar. 30, 2021.
International Search Report and Written Opinion mailed in PCT/US20/67528 dated Mar. 19, 2021.
International Search Report and Written Opinion mailed in PCT/US20/67146 dated Mar. 29, 2021.
International Search Report and Written Opinion mailed in PCT/US20/67523 dated Mar. 22, 2021.
International Search Report and Written Opinion mailed in PCT/US2020/066543 dated May 11, 2021.
Non-Final Office Action issued in U.S. Appl. No. 16/871,928 dated Aug. 25, 2021.
Non-Final Office Action issued in U.S. Appl. No. 16/943,727 dated Aug. 3, 2021.
Non-Final Office Action issued in U.S. Appl. No. 14/881,525 dated Jul. 21, 2021.
Non-Final Office Action issued in U.S. Appl. No. 16/404,283 dated Jul. 21, 2021.
Notice of Allowance and Notice of Allowability issued in U.S. Appl. No. 15/829,419 dated Jul. 26, 2021.
Woodbury et al., "Electrical Design Considerations for Drilling Rigs," IEEE Transactions on Industry Applications, vol. 1A-12, No. 4, Jul./Aug. 1976, pp. 421-431.
International Search Report and Written Opinion dated Jun. 2, 2020 in corresponding PCT Application No. PCT/US20/23809.
International Search Report and Written Opinion dated Jun. 23, 2020 in corresponding PCT Application No. PCT/US20/23912.
International Search Report and Written Opinion dated Jul. 22, 2020 in corresponding PCT Application No. PCT/US20/00017.
Office Action dated Aug. 4, 2020 in related U.S. Appl. No. 16/385,070.
Office Action dated Jun. 29, 2020 in related U.S. Appl. No. 16/404,283.
Office Action dated Jun. 29, 2020 in related U.S. Appl. No. 16/728,359.
Office Action dated Jun. 22, 2020 in related U.S. Appl. No. 16/377,861.
Canadian Office Action dated Aug. 18, 2020 in related CA Patent Application No. 2,933,444.
Canadian Office Action dated Aug. 17, 2020 in related CA Patent Application No. 2,944,968.
Morris et al., U.S. Appl. No. 62/526,869, Hydration-Blender Transport and Electric Power Distribution for Fracturing Operation; Jun. 28, 2018; USPTO; see entire document.
Final Office Action dated Feb. 4, 2021 in U.S. Appl. No. 16/597,014.
International Search Report and Written Opinion dated Feb. 4, 2021 in PCT/US20/59834.
International Search Report and Written Opinion dated Feb. 2, 2021 in PCT/US20/58906.

(56) References Cited

OTHER PUBLICATIONS

International Search Report and Written Opinion dated Feb. 3, 2021 in PCT/US20/58899.
Non-Final Office Action dated Jan. 29, 2021 in U.S. Appl. No. 16/564,185.
Final Office Action dated Jan. 21, 2021 in U.S. Appl. No. 16/458,696.
Final Office Action dated Jan. 11, 2021 in U.S. Appl. No. 16/404,283.
Non-Final Office Action dated Jan. 4, 2021 in U.S. Appl. No. 16/522,043.
International Search Report and Written Opinion dated Dec. 14, 2020 in PCT/US2020/53980.
*U.S. Well Services, LLC* v *Tops Well Services, LLC and Honghua America, LLC*, Case No. 3:19-cv-00237, Document 72-9, Declaration of Dr. Robert Schaaf, Apr. 24, 2020, 52 pages.
*U.S. Well Services, LLC* v *Tops Well Services, LLC and Honghua America, LLC*, Case No. 3:19-cv-00237 Document 72-9, Declaration of Dr. Robert Schaaf—part 2, Apr. 24, 2020, 128 pages.
*U.S. Well Services, LLC* v *Tops Well Services, LLC and Honghua America, LLC*, Case No. 3:19-cv-00237, Document 72-9, Declaration of Dr. Robert Schaaf—part 3, Apr. 24, 2020, 47 pages.
*U.S. Well Services, LLC* v *Tops Well Services, LLC and Honghua America, LLC*, Case No. 3:19-cv-00237, Document 72, Plaintiff's Opening Claim Construction Brief, Apr. 24, 2020, 37 pages.
*U.S. Well Services, LLC* v *Tops Well Services, LLC and Honghua America, LLC*, Case No. 3:19-cv-00237, Document 116, Hearing on Markman and Summary Judgment via Video Conference before the Honorable Andrew M. Edison Day 1 of 1 Day—Transcript, Jun. 15, 2020, 308 pages.
*Kirsch Research and Development, LLC* v *Tarco Specialty Products, Inc.*, Case No. 6:20-cv-00318-ADA, Document 62, Memorandum Opinion and Order Granting Defendant's Opposed Motion to Stay Pending Inter Partes Review of the '482 Patent [ECF No. 57], Oct. 4, 2021, 6 pages.
*Ledcomm LLC* v *Signfiy North America Corp., Signify Holding B.V., and Signify N.V.*, Case No. 6:20-cv-01056-ADA, Document 24, Scheduling Order, Aug. 13, 2021, 4 pages.
Transcend Shipping Systems, LLC and Hapag-Lloyd AG and Hapag-Lloyd (America) LLC, CMA CGM (America) LLC and CMA CGM S.A., Mediterranean Shipping Company S.A., Case Nos. 6:20-cv-1195-ADA, 6:21-cv-0018-ADA, and 6:21-cv-0040-ADA, Document 19, Proposed Amended Scheduling Order, Aug. 13, 2021, 6 pages.
*U.S. Well Services, Inc. and U.S. Well Services, LLC* v *Halliburton Company and Cimarex Energy Co.*, Case No. 6:21-cv-00367-ADA, Document 51, Agreed Scheduling Order, Sep. 16, 2021, 5 pages.
*U.S. Well Services, Inc. and U.S. Well Services, LLC* v *Halliburton Company and Cimarex Energy Co.*, Case No. 6:21-cv-00367-ADA, Plaintiff's Disclosure of Asserted Claims and Preliminary Infringement Contentions, Jul. 12, 2021, 9 pages.
*U.S. Well Services, Inc. and U.S. Well Services, LLC* v *Halliburton Company and Cimarex Energy Co.*, Case No. 6:21-cv-00367-ADA, Plaintiff U.S. Well Services, LLC's Disclosure of Extrinsic Evidence, Oct. 19, 2021, 10 pages.
*U.S. Well Services, Inc. and U.S. Well Services, LLC* v *Halliburton Company and Cimarex Energy Co.*, Case No. 6:21-cv-00367-ADA, Defendants' Preliminary Invalidity Contentions, Sep. 10, 2021, 193 pages.
*U.S. Well Services, Inc. and U.S. Well Services, LLC* v *Halliburton Company and Cimarex Energy Co.*, Case No. 6:21-cv-00367-ADA, Document 1-8, Exhibit H, Halliburton—All Electric Fracturing Reducing Emissions and Cost, Apr. 15, 2021, 6 pages.
Bill Lockley and Barry Wood, "What do the API Motor/Generator Features Cost and What Do They Buy You?" 2010 IEEE, Paper No. PCIC-2010-22, 10 pages.
American Petroleum Institute, "Form-wound Squirrel-Cage Induction Motors—500 Horsepower and Larger," Jun. 2004, Fourth Edition, ANSI/API Standard 541-2003, 88 pages.
Assignment record of U.S. Pat. No. 9,366, 114, accessed Aug. 19, 2021, 2 pages.
ASTM International, "Standard Specification for Steel Bars, Carbon and Alloy, Hot-Wrought, General Requirements" Oct. 13, 2006, 16 pages.
"U.S. Well Services Issues $125.5 Million Convertible Senior Secured PIK Notes, Executes License Agreement with ProFrac Manufacturing, LLC and Finalizes Amendment to Senior Secured Term Loan," Jun. 28, 2021, https://finance.yahoo.com/news/u-well-services-issues-125-203000637.html?guccounter=1, 6 pages.
Declaration of Joel N. Broussard, Case Nos. IPR2021-01032 & IPR2021-01033, Oct. 13, 2021, 9 pages.
Declaration of Dr. Robert Durham, Case Nos. IPR2021-01033, IPR2021-01032 and IPR2021-01034, Jun. 18, 2021, 179 pages.
Declaration of Robert Schaaf, Case Nos. IPR2021-01032 and IPR2021-01033, Oct. 12, 2021, 45 pages.
Declaration of Sylvia D. Hall-Ellis, Ph.D., Case Nos. IPR2021-01032, IPR2021-01033, and IPR2021-01034, Jun. 18, 2021, 173 pages.
Stephen Cary et al, "Electric Rotating Machine Standards Part II: Magnetic Wedge Design & Monitoring Methods," 2011 IEEE, Paper No. PCIC-2011-41, 8 pages.
Janice Hoppe-Spiers, "Deploying Change," Energy & Mining International, Spring 2017, http://www.emi-magazine.com, 5 pages.
Jim Harris, "U.S. Well Services LLC—Energy and Mining Magazine," Energy & Mining International, Oct. 12, 2021, https://www.emi-magazine.com/sections/profiles/1221-us-well-services-llc, 3 pages.
"Clean Fleet Reduces Emissions by 99% at Hydraulic Fracturing Sites," Fluid Power Journal, https://fluidpowerjournal.com/clean-fleet-reduces-emissions/, accessed Sep. 22, 2021, 5 pages.
Gardner Denver, Well Servicing Pump Model GD-2500Q Quintuplex—Operating and Service Manual, Aug. 2005, 46 pages.
"Halliburton Delivers Successful Grid-Powered Frac Operation," https://www.halliburton.com/en/about-us/press-release/halliburton-delivers-first-successful-grid-powered-fracturing-operation, accessed Sep. 27, 2021, 4 pages.
Hart Energy, Hydraulic Fracturing Techbook, 2015, 99 pages.
R. Mistry et al., "Induction Motor Vibrations in view of the API 541—4th Edition," IEEE, accessed Jun. 10, 2021, 10 pages.
"Game-changing hydraulic fracturing technology, reduces emissions by 99%," Intrado Globe News Wire, Oct. 1, 2014, https://www.globenewswire.com/fr/news-release-2014/10/01/670,029/10100696/en/Game-changing-hydraulic-fracturing-technology-reduces-emissions-by-99.html, 4 pages.
M. Hodowanec et al., "Introduction to API Standard 541, 4th Edition—Form-Wound Squirrel Cage Induction Motors—Larger than 500 Horsepower," 2003, IEEE, Paper No. PCIC-2003-33, 9 pages.
D. Bogh et al., "A User's Guide to Factory Testing of Large Motors: What Should Your Witness Expect," IEEE, accessed Jun. 10, 2021, 8 pages.
Dani Kass, "Fintiv Fails: PTAB Uses 'Remarkably Inaccurate' Trial Dates," Nov. 2, 2021, Law 360, 1 page.
Eugene A. Avallone et al., "Marks' Standard Handbook for Mechanical Engineers, 11th Edition," 2007, pp. 3-65, 14-2, 14-3, 14-13, 14-14, 20-91, 22-12, 22-13, 22-14, 22-15, 22-16, 10-3, 20-21, 20-22, 20-85, 20-86, 20-89, and 20-90.
T. W. Pascall et al., "Navigating the Test Requirements of API 541 4th Edition," 2007, IEEE, Paper No. PCIC-2007-11, 12 pages.
"Kerr Pumps & FlowVale Awards for Excellence in Well Completion, Northeast 2017—Awarded to: U.S. Well Services," https://www.oilandgasawards.com/winner/northeast-2017-kerr-pumps-flowvale-awards . . . ", accessed Oct. 5, 2021, 4 pages.
"New Technology Development Award—General/Products, Northeast 2015—Awarded to: U.S. Well Services, LLC," https://www.oilandgasawards.com/winner/northeast-2015-new-technology-development-award-generalproducts/#, accessed Aug. 23, 2021, 4 pages.
*U.S. Well Services, Inc.* v. *Halliburton Company*, Civil Docket for Case # 6:21-cv-00367-ADA, https://ecf.txwd.uscourts.gov/cgi-bin/DktRpt.pl?190912742001885-L_1_0-1, Accessed Nov. 29, 2021, 13 pages.
A. T. Dufresne, "How reliable are trial dates relied on by the PTAB in the Fintiv analysis?" Perkins Coie, 2021, 3 pages.

(56) References Cited

OTHER PUBLICATIONS

J. Malinowski et al., "Petrochemical Standards A Comparison Between IEEE 841-2001, API 541, and API 547," 2004, IEEE, Paper No. PCIC-2004-22, 8 pages.
"Petroleum Alumnus and Team Develop Mobile Fracturing Unit that Alleviates Environmental Impact," 2015, LSU, https://www.lsu.edu/eng/news/2015/07/20150713-mobile-fracturing-unit.php, accessed Sep. 22, 2021, 2 pages.
Liz Hampton, "Low-cost fracking offers boon to oil producers, headaches for suppliers," Reuters, Sep. 12, 2019, https://www.reuters.com/article/us-usa-oil-electric-fracturing-focus/low-cost-fracking-offers-boon-to-oil-producers-headaches-for-supplies, 11 pages.
Liz Hampton, "U.S. Well Services files e-frac patent lawsuit against Halliburton, Cimarex Energy," Reuters, Apr. 15, 2021, https://www.reuters.com/business/energy/us-well-services-files-e-frac-patent-lawsuit-against-halliburton-cimarex-energy, 10 pages.
U.S. Well Services, Inc. files suit against Halliburton Company and Cimarex Energy Co. for patent infringement, Apr. 15, 2021, PR Newswire, https://www.prnewswire.com/news-releases/us-well-services-inc-files-suit-against-halliburton-company-and-cimarex-energy-co-for-patent-infringement-301270118.html, 2 pages.
Services—U.S. Well Services, http://uswellservices.com/services/, accessed Nov. 13, 2021, 10 pages.
OSHA Publications, U.S. Department of Labor—Occupational Safety and Health Administration, https://web.archive.org/web/20150406054914/https://www.osha.gov/pls/publications/publication.AthruZ?pType=Industry, Jun. 13, 2021, 3 pages.
Steven C. Carlson, Weaponizing IPRs, Landslide, Sep. 22, 2019, 10 pages.
Declaration of Dr. Mark Ehsani, IPR2021-01066, Jul. 2, 2021, 213 pages.
Declaration of Dr. Robert Schaaf, IPR2021-01066, Nov. 17, 2021, 43 pages.
Amazon.com purchase page for Electrical Engineering Reference Manual for the Electrical and Computer PE Exam, Sixth Edition, https://web.archive.org/web/20070103124447/https:/www.amazon.com/Electrical-Engineering-Reference-Manual-Computer/dp/1888577568/, accessed Jul. 23, 2021, 7 pages.
Public Catalog of the U.S. Copyright Office for search result: electrical engineering reference manual, https://cocatalog.loc.gov/cgi-bin/Pwebrecon.cgi?v1=6&ti=1, 6&Search_Arg=electrical engineering reference manual&Search_Code=TALL&CNT=25&Pl . . . , accessed Jul. 21, 2021, 2 pages.
Declaration of Robert Schaaf, IPR2021-01238, Nov. 17, 2021, 38 pages.
John A. Camera, PE, Electrical Engineering Reference Manual for the Electrical and Computer PE Exam, Sixth Edition, 2002, 102 pages.
IEEE 100 The Authoritative Dictionary of IEEE Standards Terms Seventh Edition, 2000, 7 pages.
National Electrical Manufacturers Association, NEMA ICS 61800-4 Adjustable Speed Electrical Power Drive Systems, Part 4: General Requirements—Rating Specifications for A.C. Power Drive Systems above 1000 V a.c. and Not Exceeding 35 kV, 2004 22 pages.
Professional Publications, Inc., FE Exam, PE Exam, ARE Exam, and NCIDQ Exam Review / Professional Engineering Licensing, About PPI, https://web.archive.org/web/20031219231426/http://ppi2pass.com:80/catalog/servlet/MyPpi_pg_aboutppi.html, accessed Jul. 22, 2021, 1 page.
Professional Publications, Inc., FE Exam, PE Exam, ARE Exam, and NCIDQ Exam Review / Professional Engineering Licensing, What PPI Customers Say, https://web.archive.org/web/20031226130924/http://ppi2pass.com:80/catalog/servlet/MyPpi_pg_comments-EEcomments.html, accessed Jul. 22, 2021, 2 pages.
Professional Publications, Inc., FE Exam, PE Exam, ARE Exam, and NCIDQ Exam Review / Professional Engineering Licensing, Homepage, https://web.archive.org/web/20040209054901/http://ppi2pass.com:80/catalog/servlet/MyPpi, accessed Jul. 19, 2021, 1 page.
Professional Publications, Inc., FE Exam, PE Exam, ARE Exam, and NCIDQ Exam Review / Professional Engineering Licensing, The PPI Online Catalog, https://web.archive.org/web/20040215142016/http://ppi2pass.com:80/catalog/servlet/MyPpi_ct_MAIN, accessed Jul. 19, 2021, 2 pages.
Professional Publications, Inc., FE Exam, PE Exam, ARE Exam, and NCIDQ Exam Review / Professional Engineering Licensing, Electrical PE Exam Review Products, https://web.archive.org/web/20040214233851/http://ppi2pass.com:80/catalog/servlet/MyPpi_ct_ELECTRICAL, accessed Jul. 19, 2021, 7 pages.
Professional Publications, Inc., FE Exam, PE Exam, ARE Exam, and NCIDQ Exam Review / Professional Engineering Licensing, Instructor's Corner, https://web.archive.org/web/20031219232547/http://ppi2pass.com:80/catalog/servlet/MyPpi_pg_corner-corner.html, accessed Jul. 19, 2021, 2 pages.
Professional Publications, Inc., FE Exam, PE Exam, ARE Exam, and NCIDQ Exam Review / Professional Engineering Licensing, Teaching an Electrical and Computer Engineering PE Exam Review Course, https://web.archive.org/web/20031223100101/http://ppi2pass.com:80/catalog/servlet/MyPpi_pg_corner-teachee.html, accessed Jul. 19, 2021, 2 pages.
Professional Publications, Inc., Books for the FE, PE, FLS and PLS Exams, Spring 2004, http://www.ppi2pass.com/corner/catalog.pdf, 16 pages.
Lionel B. Roe, Practices and Procedures of Industrial Electrical Design, 1972, McGraw-Hill, Inc., Chapter 2: The Basic Electric System, 11 pages.
Declaration of Duncan Hall, Jul. 23, 2021, https://web.archive.org/web/20031219231426/http://ppi2pass.com:80/catalog/servlet/MyPpi_pg_aboutppi.html, 12 pages.
Declaration of Robert Durham, IPR2021-01315, Aug. 12, 2021, 209 pages.
Declaration of Robert Schaaf, IPR2021-01315, Nov. 19, 2021, 39 pages.
*U.S. Well Services, Inc. and U.S. Well Services, LLC* v *Halliburton Company and Cimarex Energy Co.*, Case No. 6:21-cv-00367-ADA, Document 63, Defendants' Claim Construction Brief in Reply to U.S. Well Services, LLC's Responsive Brief, Dec. 2, 2021, 30 pages.
*U.S. Well Services, Inc.* v *Halliburton Company*, Case No. 6:21-cv-00367-ADA, Civil Docket, accessed Dec. 17, 2021, 14 pages.
*U.S. Well Services, Inc.* v *Halliburton Company*, Case No. 6:21-cv-00367-ADA, Document 64, Order Resetting Markman Hearing, Dec. 8, 2021, 1 page.
Approved American National Standard, ANSI/NEMA MG Jan. 2011, American National Standard Motors and Generators, Dec. 9, 2021, 636 pages.
Comprehensive Power: Power it Up, Feb. 27, 2013, 28 pages.
Declaration of Robert Schaaf, IPR2021-01316, Nov. 19, 2021, 33 pages.
Declaration of Robert Durham, IPR2021-01316, Aug. 13, 2021, 75 pages.
Declaration of Robert Schaaf, IPR2021-01538, Dec. 28, 2021, 40 pages.
Declaration of Dr. L. Brun Hilbert, Jr., P.E., IPR2021-01538, Sep. 22, 2021, 99 pages.
Katsuhiko Ogata, Modern Control Engineering: Third Edition, 1997, 2 pages.
49 C.F.R. Part 393 (Oct. 1, 2006), 36 pages.
"VZ Environmental Award of Excellence in Environmental Stewardship, Rocky Mountain 2016—Awarded to: U.S. Well Services, LLC," Oil & Gas Awards, 2016, https://www.oilandgasawards.com/winner/rocky-mountain-2016-vz-environmental-award-for-excellence-in-environmental-stewardship, accessed Aug. 23, 2021, 4 pages.
Austin H. Bonnett, "Root Cause Failure Analysis for AC Induction Motors in the Petroleum and Chemical Industry," 2010, IEEE, Paper No. PCIC-2010-43, 13 pages.
Carolyn Davis, "Natural Gas Finding Niche in E-Fracking, But Diesel Still Rules," Sep. 6, 2019, Natural Gas Intel, https://www.naturalgasintel.com/natural-gas-finding-niche-in-e-fracking-but-diesel-still-rules, 9 pages.
Tim Rahill and Michael C. Fousha, "Sorting Out the Overlap," Jan./Feb. 2009, IEEE Industry Applications Magazine, 12 pages.

(56) References Cited

OTHER PUBLICATIONS

Jodi Shafto, "Growth in electric-fracking fleets stunted by tight producer budgets," Aug. 6, 2019, S&P Global Market Intelligence, https://wwww.spglobal.com/marketintelligence/en/news-insights/latest-news-headlines/growth-in-electric-fracking-fleets-stunted-by-tight-producer-budgets, accessed Sep. 16, 2021, 4 pages.
A. H. Bonnett et al., "Squirrel Cage Rotor Options for A.C. Induction Motors," IEEE, accessed May 18, 2021, 4 pages.
U.S. Well Services Investor and Analyst Update: Second Quarter 2021 in Review, 2021, 7 pages.
Standing Order Governing Proceedings—Patent Cases, in the United States District Court for the Western District of Texas, Waco Division, filed Nov. 17, 2021, 11 pages.
U.S. Well Services—Services, http://uswellservices.com/services/, accessed Nov. 13, 2021, 10 pages.
Elsevier, "Variable Speed Pumping—A Guide to Successful Applications," 2019, 186 pages.
*U.S. Well Services, Inc., and U.S. Well Services, LLC* v *Halliburton Company, Cimarex Energy Co., Halliburton Energy Services, Inc., and Halliburton US Techologies, Inc*., Case No. WA:21-CV-00367-ADA, Document 61, Order Setting Markman Hearing, Nov. 29, 2021, 1 page.
*U.S. Well Services, Inc., and U.S. Well Services, LLC* v *Halliburton Company, Cimarex Energy Co., Halliburton Energy Services, Inc., and Halliburton US Techologies, Inc*., Case No. WA:21-CV-00367-ADA, Document 61, Order Resetting Markman Hearing, Dec. 8, 2021, 1 page.
Affidavit of Duncan Hall, Internet Archives on Jun. 7, 2021, https://web.archive.org/web/20120917102614/http:/www.quincieoilfield.com/pdf/3.0%20Gardner%20Denver/2500/GD2500Q%200p%20&%20Service%20Manual.pdf, 76 pages.
Collins English Dictionary, Twelfth Edition, 2014, p. 1005.
Declaration of Robert Schaaf, IPR2021-01539, Jan. 25, 2022, 37 pages.
Department of Transportation, Federal Motor Carrier Safety Administration, 49 CFR Parts 390, 392 and 393—Parts and Accessories Necessary for Safe Operation; General Amendments; Final Rule, Federal Register, Aug. 15, 2005, vol. 70, No. 156, 49 pages.
D. Nedelcut et al., "On-line and Off-line Monitoring-Diagnosis System (MDS) for Power Transformers," IEEE, 2008 International Conference on Condition Monitoring and Diagnosis, Beijing, China, Apr. 21-24, 2008, 7 pages.
Random House Webster's Unabridged Dictionary, Second Edition, 2001, p. 990.
A. B. Lobo Ribeiro et al, "Multipoint Fiber-Optic Hot-Spot Sensing Network Integrated Into High Power Transformer for Continuous Monitoring," IEEE Sensors Journal, Jul. 2008, vol. 8, No. 7, pp. 1264-1267.
Society of Automotive Engineers, SAE J1292: Automobile, Truck, Truck-Tractor, Trailer, and Motor Coach Wiring, 49 CFR 393.28, Oct. 1981, 6 pages.
"StarTech NETRS2321E 1 Port RS-232/422/485 Serial over IP Ethernet Device Server," StarTech, http://www.amazon.com/StarTech-NETRS2321E-RS-232-Serial-Ethernet/dp/B000YN0N0S, May 31, 2014, 4 pages.
"StarTech.com 1 Port RS232 Serial to IP Ethernet Converter (NETRS2321P)," StarTech, http://www.amazon.com/StarTech-com-Serial-Ethernet-Converter-NETRS232IP/dp/B00FJEHNSO, Oct. 9, 2014, 4 pages.
"TCP/IP Ethernet to Serial RS232 RS485 RS422 Converter," Atc, http://www.amazon.com/Ethernet-Serial-RS232-RS485-Converter/dp/B00ATV2DX2, Feb. 1, 2014, 2 pages.
"SainSmart TCP/IP Ethernet to Serial RS232 RS485 Intelligent Communication Converter," SainSmart, http://www.amazon.com/SainSmart-Ethernet-Intelligent-Communication-Converter/dp/B008BGLUHW, Aug. 17, 2014, 4 pages.
"Global Cache iTach, IP to Serial with PoE (IP2SL-P)," Global Cache, https://www.amazon.com/Global-Cache-iTach-Serial-IP2SL-P/dp/B003BFVNS4/, Oct. 30, 2014, 3 pages.
Declaration of Robert Durham, IPR2022-00074, Nov. 8, 2021, 177 pages.
Declaration of Robert Schaaf, IPR2022-00074, Feb. 17, 2022, 36 pages.
Eugene A. Avallone, Marks' Standard Handbook for Mechanical Engineers: 11th Edition, 2007, p. 16-4 and 16-22.
Moxa 802.11 Ethernet to Serial, Moxastore, http://www.moxastore.com/Moxa_802_11_Wi_Fi_Ethernet_to_Serial_s/587.html, May 24, 2016, 1 page.
Project Registration, Moxastore, http://www.moxastore.com, Feb. 15, 2015, 2 pages.
About Us, Moxastore, http://www.moxastore.com/aboutus.asp, Mar. 8, 2015, 1 page.
Declaration of Duncan Hall, Internet Archive, Oct. 26, 2021, https://web.archive.org/web/20140531134153/http://www.amazon.com/StarTech-NETRS2321E-RS-232-Serial-Ethernet/dp/B000YBONOS, 43 pages.
Michael Quentin Morton, Unlocking the Earth: A Short History of Hydraulic Fracturing (2013), GeoExpro, vol. 10, No. 6, 5 pages.
Accommodating Seismic Movement, Victaulic Company, 2015, https://web.archive.org/web/20150412042941/http://www.victaulic.com:80/en/businesses-solutions/solutions/accommoda . . . , 2 pages.
Style W77 AGS Flexible Coupling, Victaulic Company 2015, https://web.archive.org/web/20150423052817/http://www.victaulic.com:80/en/products-services/products/style-w77-ags-f . . . , 1 page.
AGS Large Diameter Solutions, Victaulic Company, 2015, https://web.archive.org/web/20150419063052/http://www.victaulic.com:80/en/businesses-solutions/solutions/advanced-gr . . . , 2 pages.
Chiksan Original Swivel Joints, FMC, 1997, 16 pages.
Coors Tek Flowguard Products, 2012, 8 pages.
Declaration of Sylvia D. Hall-Ellis, IPR2022-00610, Feb. 28, 2022, 98 pages.
Gardner Denver, Well Servicing Pump Model GD-2500Q, GD-2500Q-HD, Quintuplex Pumps, Sep. 2011, 45 pages.
Eugene A. Avallone, Marks' Standard Handbook for Mechanical Engineers: 11th Edition, 2007, Section 14, 18 pages.
Mohinder L. Nayyar, Piping Handbook Seventh Edition, McGraw-Hill Handbook, 2000, 77 pages.
Pulsation Dampers, Coorstek, 2014, https://web.archive.org/web/20140919005733/http://coorstek.com/markets/energy_equip . . . , 2 pages.
M. E. Rahman et al., "Wire rope isolators for vibration isolation of equipment and structures—A review," IOP Conference Series Materials Science and Engineering, Apr. 2015, 12 pages.
Victaulic Couplings Vibration Attenuation Characteristics, Victaulic, Publication 26.04, Oct. 2014, 5 pages.
Thorndike Saville, The Victaulic Pipe Joint, Journal of American Water Works Association, Nov. 1922, vol. 9, No. 6, pp. 921-927.
J. C. Wachel et al., "Analysis of Vibration and Failure Problems in Reciprocating Triplex Pumps for Oil Pipelines," The American Society of Mechanical Engineers, Presented at the Energy-Sources and Technology Conference and Exhibition, Dallas, Texas, Feb. 17-21, 1985, 8 pages.
Declaration of Nathaniel E. Frank-White, Internet Archive, Feb. 17, 2022, http://web.archive.org/web/20140329090440/http://www.enidline.com/pdffiles/WR_Catalog_2012.pdf, 82 pages.
Wire Rope Isolator Technologies, Enidine, Dec. 2011, 78 pages.
World's Best Swivel Joints, Flowvalve, 2013, https://web.archive.org/web/20150117041757/http://www.flowvalve.com:80/swivels, 10 pages.
Gardner Denver, 3" 1502 Male Hammer Union Discharge Flange, 2005, 13 pages.
Donald G. Fink, "Standard Handbook for Electrical Engineers—Thirteenth Edition," 1993, McGraw-Hill Inc., pp. 10-13, 20-21, 20-22, 20-85, 20-20, 20-89, 20-90, 20-91, 22-12, 22-13, 22-14, 22-15 and 22-16.
Email from Michael See on Jun. 10, 2021 regarding API-541 Fourth Edition: Public Availability, 2 pages.
Halliburton, Halliburtion All-Electric Fracturing Reducing Emissions and Cost Brochure, 2021, 6 pages.
IEEE Power Engineering Society, 112 IEEE Standard Test Procedure for Polyphase Induction Motors and Generators, 2004, 87 pages.

(56) References Cited

OTHER PUBLICATIONS

*U.S. Well Services, LLC* v *Tops Well Services, LLC*, Case No. 3:19-cv-237, Document 135, Order, Sep. 22, 2021, 2 pages.
*U.S. Well Services, Inc. and U.S. Well Services, LLC* v *Halliburton Company and Cimarex Energy Co*., Case No. 6:21-cv-00367-ADA, Document 56, Defendants' Opening Claim Construction Brief, Oct. 27, 2021, 46 pages.
John Daniel, "8.30 DEP Industry Observations: New Flac Fleet; New Fleet Designs Forthcoming," Daniel Energy Partners, Aug. 30, 2020, 13 pages.
Declaration of Joel N. Broussard, IPR2021-01034, IPR2021-01035, IPR2021-01036, and IPR2021-01037, Oct. 20, 2021, 11 pages.
Declaration of Robert Schaaf, IPR2021-01034, Oct. 20, 2021, 47 pages.
Declaration of Dr. Mark Ehsani, IPR2021-01035, Jun. 18, 2021, 188 pages.
Stan Gibilisco, The Illustrated Dictionary of Electronics: Audio/Video Consumer Electronics Wireless Technology—Eighth Edition, 2001, p. 667.
Declaration of Robert Schaaf, IPR2021-01035, Oct. 20, 2021, 51 pages.
Declaration of Dr. L. Brun Hilbert, P.E., IPR2021-01037 and IPR2021-01038, Jun. 21, 2021, 124 pages.
Declaration of Robert Schaaf, IPR2021-01037, Oct. 20, 2021, 52 pages.
Zeus Electric Pumping Unit, Halliburton, http://www.halliburton.com/en/products/zeus-electric-pumping-unit, 2021, 4 pages.
Declaration of Joel N. Broussard, IPR2021-01038, Oct. 20, 2021, 11 pages.
*LedComm LLC* v *Signify North America Corporation*, Case No. 6:20-cv-01056-ADA, Civil Docket, accessed Dec. 8, 2021, 11 pages.
*U.S. Well Services, Inc*. v *Halliburton Company*, Case No. 6:21-cv-00367-ADA, Civil Docket, accessed Dec. 13, 2021, 14 pages.
Declaration of Robert Schaaf, IPR2021-01038, Nov. 10, 2021, 40 pages.
*Transcend Shipping Systems LLC* v *Mediterranean Shipping Company S.A*., Case No. 6:21-cv-00040, Document 27, Order of Dismissal with Prejudice, Dec. 7, 2021, 1 page.
Centers for Disease Control and Prevention, NIOSH Numbered Publications, https://web.archive.org/web/20120721180008/http://www.cdc.org/niosh/pubs/all_date_desc_nopubnumbers.html, 2012, 57 pages.
America Invents Act, H.R. Rep. No. 112-98, Jun. 1, 2011, 165 pages.
Declaration of Joel N. Broussard, IPR2021-01065, Oct. 20, 2021, 11 pages.
Declaration of Dr. Robert Durham, IPR2021-01065, Jun. 18, 2021, 138 pages.
Declaration of Robert Schaaf, IPR2021-01065, Nov. 10, 2021, 33 pages.
U.S. Pat. No. 9,410,410, Excerpt—Response to Non-Final Office Action filed Feb. 3, 2016, 57 pages.
Industrial Safety & Hygiene News, OSHA issues hazard alert for fracking and drilling, Jan. 6, 2015, 1 page.
Portfolio Media Inc., A Shift to Sand: Spotlight on Silica Use in Fracking, Law360, https://www.law360.com/articles/366057/print?section=energy, accessed Jun. 10, 2021, 5 pages.
Henry Chajet, "OSHA Issues Alert on Non-Silica Fracking Hazards," Jan. 30, 2015, National Law Review Newsroom, 2 pages.
*U.S. Well Services, LLC*, v *Voltagrid LLC, Nathan Ough, Certarus (USA) Ltd., and Jared Oehring*, Case No. 4:21-cv-3441-LHR, Document 13, Plaintiff U.S. Well Services, LLC's Motion for Preliminary Injunction and Request for dearing, Nov. 4, 2021, 311 pages.
U.S. Department of Labor—Occupational Safety and Health Administration, Hazard Alert—Worker Exposure to Silica during Hydraulic Fracturing, 2012, 7 pages.
U.S. Department of Labor—Occupational Safety and Health Administration, OSHA and NIOSH issued hazard alert on ensuring workers in hydraulic fracturing operations have appropriate protections from silica exposure, Jun. 21, 2012, 4 pages.
Occupational Safety and Health Administration—Home, United States Department of Labor, https://web.archive.org/web/20120722160756/http://www.osha.gov/, accessed Jun. 13, 2021, 2 pages.
Industry/Hazard Alerts, United States Department of Labor, https://web.archive.org/web/20120801064838/http://www.osha.gov:80/hazardindex.html, accessed Jun. 13, 2021, 1 page.
Hazard Alert—Worker Exposure to Silica during Hydraulic Fracturing, United States Department of Labor, https://web.archive.org/web/20120808200919/http://www.osha.gov/dts/hazardalerts/hydraulic_frac_hazard_alert.html, accessed Jun. 13, 2021, 5 pages.
A. Abbott, Crippling the Innovation Economy: Regulatory Overreach at the Patent Office, Regulatory Transparency Project, Aug. 14, 2017, 35 pages.
D. Heidel, Safety and Health Management Aspects for Handling Silica-based Products and Engineered Nanoparticles in Sequences of Shale Reservoir Stimulations Operations, Society of Petroleum Engineers, 2004, 4 pages.
Testimony of Judge Paul R. Michel (Ret.) United States Court of Appeals for the Federal Circuit Before the Subcommittee on Intellectual Property, U.S. Senate Committee on the Judiciary, Jun. 4, 2019, 8 pages.
Bernard D. Goldstein, The Role of Toxicological Science in Meeting the Challenges and Opportunities of Hydraulic racturing, 2014, Toxicological Sciences, vol. 139, No. 2, pp. 271-283.
Mike Soraghan, OSHA issues hazard alert for fracking and drilling, E&E, Dec. 10, 2014, 1 page.

* cited by examiner

INDEPENDENT CONTROL OF AUGER AND HOPPER ASSEMBLY IN ELECTRIC BLENDER SYSTEM

CROSS REFERENCE TO RELATED APPLICATIONS

This application is a continuation of U.S. patent application Ser. No. 15/294,349, filed Oct. 14, 2016, now U.S. Pat. No. 10,232,332, issued Mar. 19, 2019, which claims priority to U.S. Provisional Application Ser. No. 62/242,657, filed Oct. 16, 2015 and is a continuation-in-part of, and claims priority to and the benefit of co-pending U.S. patent application Ser. No. 15/202,085, filed Jul. 5, 2016, which claimed priority to and the benefit of Ser. No. 13/679,689, filed Nov. 16, 2012, which issued as U.S. Pat. No. 9,410,410 on Aug. 9, 2016; the full disclosures of which are hereby incorporated by reference herein for all purposes.

BACKGROUND OF THE INVENTION

1. Field of Invention

The present disclosure relates to operations in a subterranean formation. In particular, the present disclosure relates to a hydraulic fracturing system.

2. Description of Related Art

Hydraulic fracturing is a technique used to stimulate production from some hydrocarbon producing wells. The technique usually involves injecting fluid into a wellbore at a pressure sufficient to generate fissures in the formation surrounding the wellbore. Typically, the pressurized fluid is injected into a portion of the wellbore that is pressure isolated from the remaining length of the wellbore so that fracturing is limited to a designated portion of the formation. The fracturing fluid slurry, whose primary component is usually water, includes proppant (such as sand or ceramic) that migrate into the fractures with the fracturing fluid slurry and remain to prop open the fractures after pressure is no longer applied to the wellbore. Other than water, potential primary fluids for the slurry include nitrogen, carbon dioxide, foam (nitrogen and water), diesel, or other fluids. The fracturing slurry may also contain a small component of chemical additives, which can include scale build up inhibitors, friction reducing agents, viscosifiers, stabilizers, pH buffers, acids, biocides, and other fluid treatments. In embodiments, the chemical additives comprise less than 1% of the fracturing slurry.

The fluids are blended with a proppant in the blender unit. The proppant is supplied from a nearby proppant source via a conveyor into a hopper associated with the blender unit. The hopper associated with the blender unit can be difficult to align with the proppant feed. This difficulty arises, in part, because during transport on a trailer, the hopper of the blender unit is typically placed in a raised position. In order to properly position the hopper relative to the conveyor, so that the hopper can receive proppant, three steps are necessary, including 1) the trailer carrying the blender unit must be aligned with the conveyor, 2) power must be connected to the blender unit, and 3) the hopper must be lowered into position to receive proppant from the conveyor.

The problem lies in the necessary order of these three steps in known systems. For example, typically, power to the blender unit is not connected until all trailers and equipment are in place at the well site. Because the hopper cannot be lowered into position until power is connected to the blender unit, this means that the blender unit trailer must be positioned relative to the conveyor while the hopper unit is in the elevated position. The problem with this is that when in the hopper is in the elevated position, it is very difficult to tell when the trailer is properly aligned with the conveyor. Furthermore, by the time power is connected, allowing the hopper to be lowered, it is too late to reposition the blender unit trailer if the hopper does not properly align with the conveyor.

SUMMARY OF THE INVENTION

Disclosed herein are embodiment systems and methods of hydraulic fracturing with independent control of an auger and hopper assembly. In embodiments, a hydraulic fracturing system includes a blender unit capable of mixing proppant and fluid. A first power supply, such as an electric generator, can be used to power the blender unit. The system can further include an auger and hopper assembly, which includes one or more augers, a hopper, and a hydraulic cylinder. The hopper can receive proppant through an upper opening and transport the proppant out of the hopper using one or more augers. The hydraulic cylinder, when activated by one or more actuators for example, can move the auger and hopper assembly between a stowed position and a deployed position.

A second power supply, such as a battery, can power the auger and hopper assembly. The second power supply can operate independently of the first power supply. In other words, in embodiments, the battery can supply power to the auger and hopper assembly with no power input from the electric generator. The battery, however, can be recharged by the electric generator when the electric generator is on. Thus, the first power supply can recharge the second power supply, but the second power supply operates independently when powering the auger and hopper assembly. In embodiments, the second power supply is a 12-volt direct current battery. In embodiments, one or more batteries are connected in parallel to form a power supply.

The hydraulic fracturing system can further include a blender tub positioned beneath the auger outlets. When the auger and hopper assembly is in the deployed position, the auger outlets become aligned with upper opening of the blender tub. That is, the approximate center of the blender tub can be positioned below the auger outlets when the auger and hopper assembly is in the deployed position.

Methods according to various embodiments can include positioning a blender unit near a proppant source. The blender unit can be mobile. For example, it can be positioned on a truck or trailer that includes various other components of a blender system, such as a blender tub with an upper opening, and an auger and hopper assembly with the hopper having an upper opening and the auger outlets being positioned above the center of the blender tub. An example method can further include deploying the auger and hopper assembly from a stowed position to a deployed position. When the assembly is in the deployed position, the hopper will be aligned with a proppant feed from the proppant source. For example, the proppant can be fracturing sand, and the proppant feed can be a sand conveyor configured to deliver sand to the hopper. Deploying the assembly, according to various embodiments, includes powering one or more actuators with a battery. In addition, the blender unit can be connected to a power supply, which is independent from the battery that powers the actuators of the auger and hopper assembly.

When the auger and hopper assembly is moved to the deployed position, proppant from the proppant feed can be received into the hopper through the upper opening of the hopper. One or more augers with inlets positioned to receive proppant from the hopper can move proppant out of the hopper. The auger outlets are positioned above the blender tub when the auger and hopper assembly is in the deployed position. Proppant from the hopper can then be released via the auger outlets into the blender tub, where it is received by the blending unit. The blending unit can then mix the proppant with a fluid to prepare a fracturing slurry. This slurry can be pumped to a fracturing pump system, where it can be highly pressurized and pumped into a subterranean formation, as discussed in more detail below.

BRIEF DESCRIPTION OF DRAWINGS

Some of the features and benefits of the present invention having been stated, others will become apparent as the description proceeds when taken in conjunction with the accompanying drawings, in which.

Figure 1:
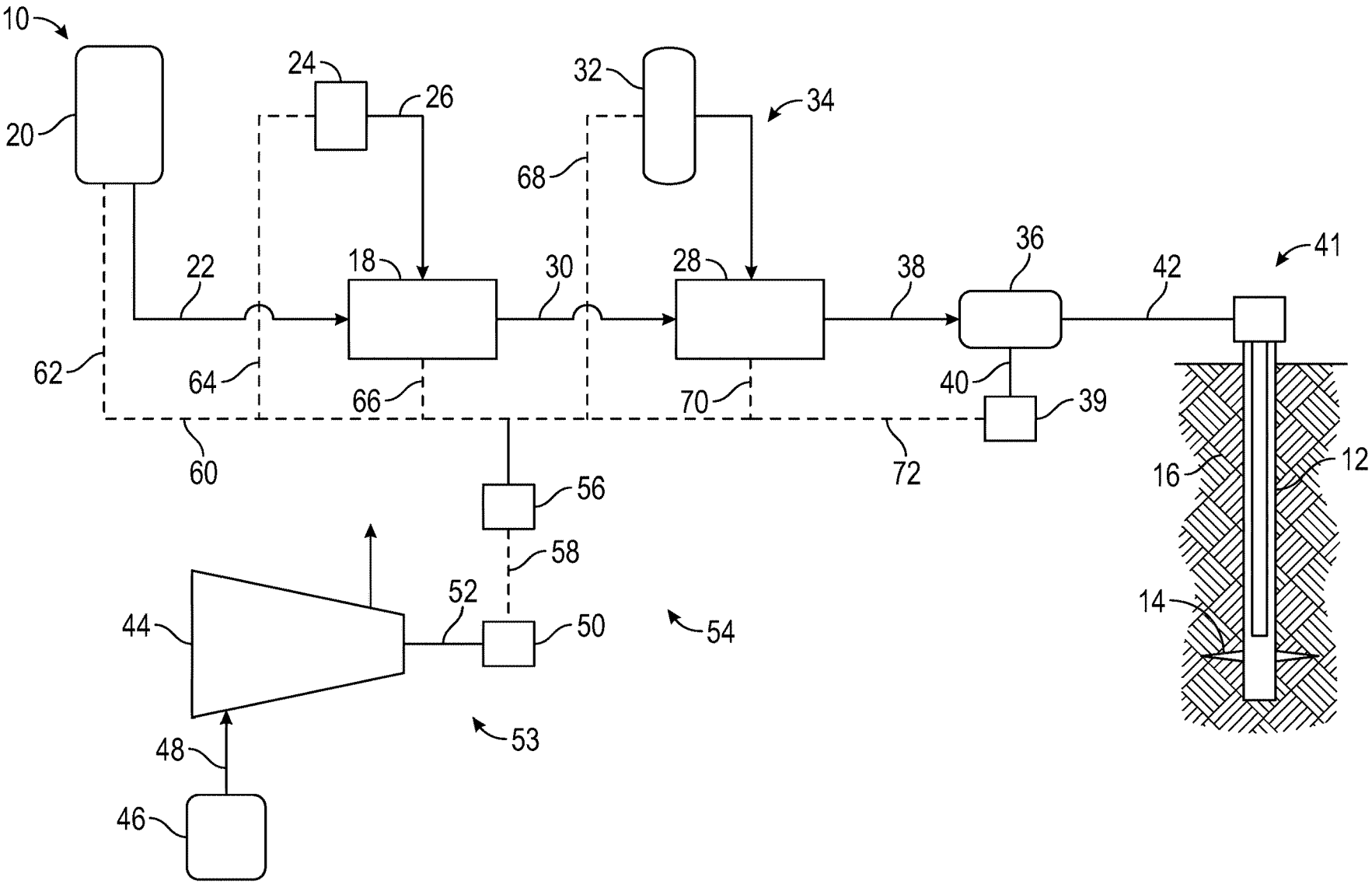
FIG. 1 is a schematic example of a hydraulic fracturing system according to certain embodiments.

While the invention will be described in connection with certain embodiments, it will be understood that it is not intended to limit the invention to those embodiments. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 is a schematic example of a hydraulic fracturing system 10 that is used for pressurizing a wellbore 12 to create fractures 14 in a subterranean formation 16 that surrounds the wellbore 12. Included with the system 10 is a hydration unit 18 that receives fluid from a fluid source 20 via line 22, and also selectively receives additives from an additive source 24 via line 26. Additive source 24 can be separate from the hydration unit 18 as a stand-alone unit, or can be included as part of the same unit as the hydration unit 18. The fluid, which in one example is water, is mixed inside of the hydration unit 18 with the additives. In an embodiment, the fluid and additives are mixed over a period of time to allow for uniform distribution of the additives within the fluid.

In the example of FIG. 1, the fluid and additive mixture is transferred to a blender unit 28 via line 30. A proppant source 32 contains proppant, which is delivered to the blender unit 28 as represented by line 34, where line 34 can be a conveyer. Inside the blender unit 28, the proppant and fluid/additive mixture are combined to form a fracturing slurry, which is then transferred to a fracturing pump system 36 via line 38; thus fluid in line 38 includes the discharge of blender unit 28 which is the suction (or boost) for the fracturing pump system 36. Blender unit 28 can have an onboard chemical additive system, such as with chemical pumps and augers. Optionally, additive source 24 can provide chemicals to blender unit 28; or a separate and stand-alone chemical additive system (not shown) can be provided for delivering chemicals to the blender unit 28. In an example, the pressure of the slurry in line 38 ranges from around 80 psi to around 100 psi. The pressure of the slurry can be increased up to around 15,000 psi by pump system 36.

A motor 39, which connects to pump system 36 via connection 40, drives pump system 36 so that it can pressurize the slurry. In one example, the motor 39 is controlled by a variable frequency drive ("VFD"). In one embodiment, a motor 39 may connect to a first pump system 36 via connection 40 and to a second pump system 36 via a second connection 40. After being discharged from pump system 36, slurry is pumped into a wellhead assembly 41; discharge piping 42 connects discharge of pump system 36 with wellhead assembly 41 and provides a conduit for the slurry between the pump system 36 and the wellhead assembly 41. In an alternative, hoses or other connections can be used to provide a conduit for the slurry between the pump system 36 and the wellhead assembly 41. Optionally, any type of fluid can be pressurized by the fracturing pump system 36 to form injection fracturing fluid that is then pumped into the wellbore 12 for fracturing the formation 14, and is not limited to fluids having chemicals or proppant.

An example of a turbine 44 is provided in the example of FIG. 1 and which receives a combustible fuel from a fuel source 46 via a feed line 48. In one example, the combustible fuel is natural gas, and the fuel source 46 can be a container of natural gas or a well (not shown) proximate the turbine 44. Combustion of the fuel in the turbine 44 in turn powers a generator 50 that produces electricity. Shaft 52 connects generator 50 to turbine 44. The combination of the turbine 44, generator 50, and shaft 52 define a turbine generator 53. In another example, gearing can also be used to connect the turbine 44 and generator 50.

An example of a micro-grid 54 is further illustrated in FIG. 1, and which distributes electricity generated by the turbine generator 53. Included with the micro-grid 54 is a transformer 56 for stepping down voltage of the electricity generated by the generator 50 to a voltage more compatible for use by electrical powered devices in the hydraulic fracturing system 10. In another example, the power generated by the turbine generator and the power utilized by the electrical powered devices in the hydraulic fracturing system 10 are of the same voltage, such as 4160 V so that main power transformers are not needed. In one embodiment, multiple 3500 kVA dry cast coil transformers are utilized. Electricity generated in generator 50 is conveyed to transformer 56 via line 58. In one example, transformer 56 steps the voltage down from 13.8 kV to around 600 V. Other step down voltages can include 4,160 V, 480 V, or other voltages. The output or low voltage side of the transformer 56 connects to a power bus 60. Lines 62, 64, 66, 68, 70, and 72 connect to power bus 60 and deliver electricity to electrically powered end users in the system 10. More specifically, line 62 connects fluid source 20 to bus 60, line 64 connects additive source 24 to bus 60, line 66 connects hydration unit 18 to bus 60, line 68 connects proppant source 32 to bus 60, line 70 connects blender unit 28 to bus 60. Another line can connect bus 60 to an optional variable frequency drive ("VFD") (not shown). The VFD can connect to motor 39. In one example, the VFD selectively provides electrical power to motor 39 via a dedicated or shared line, and can be used to control operation of motor 39, and thus also operation of pump 36.

In an example, additive source 24 contains ten or more chemical pumps for supplementing the existing chemical pumps on the hydration unit 18 and blender unit 28. Chemicals from the additive source 24 can be delivered via lines 26 to the hydration unit 18 and/or the blender unit 28. In certain embodiments, the elements of the system 10 are mobile and can be readily transported to a wellsite adjacent the wellbore 12, such as on trailers or other platforms equipped with wheels or tracks.

Figure 2:
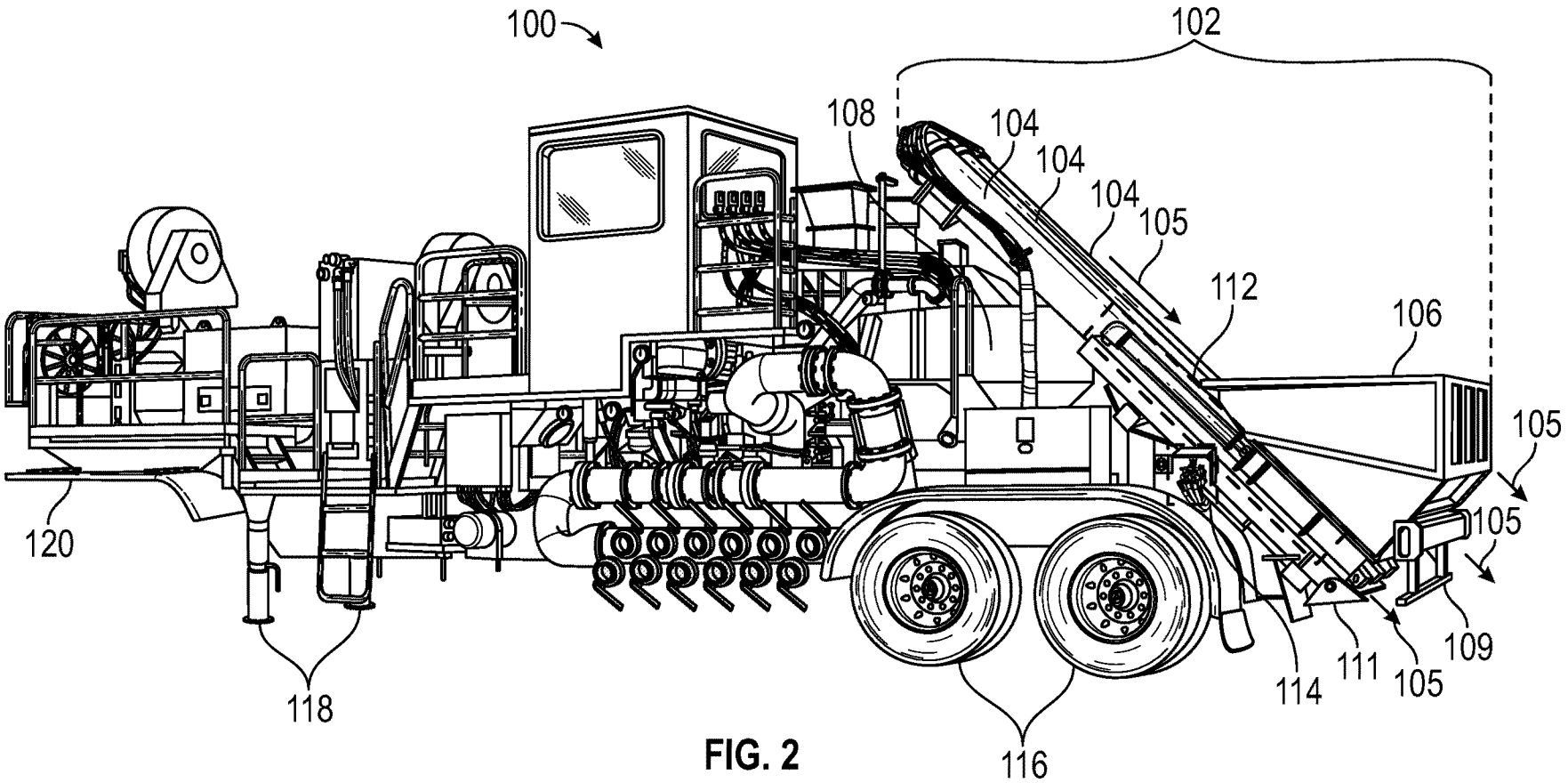
FIG. 2 is a side perspective view of a blender system with an auger and hopper assembly in a stowed position according to certain embodiments.
Figure 3:
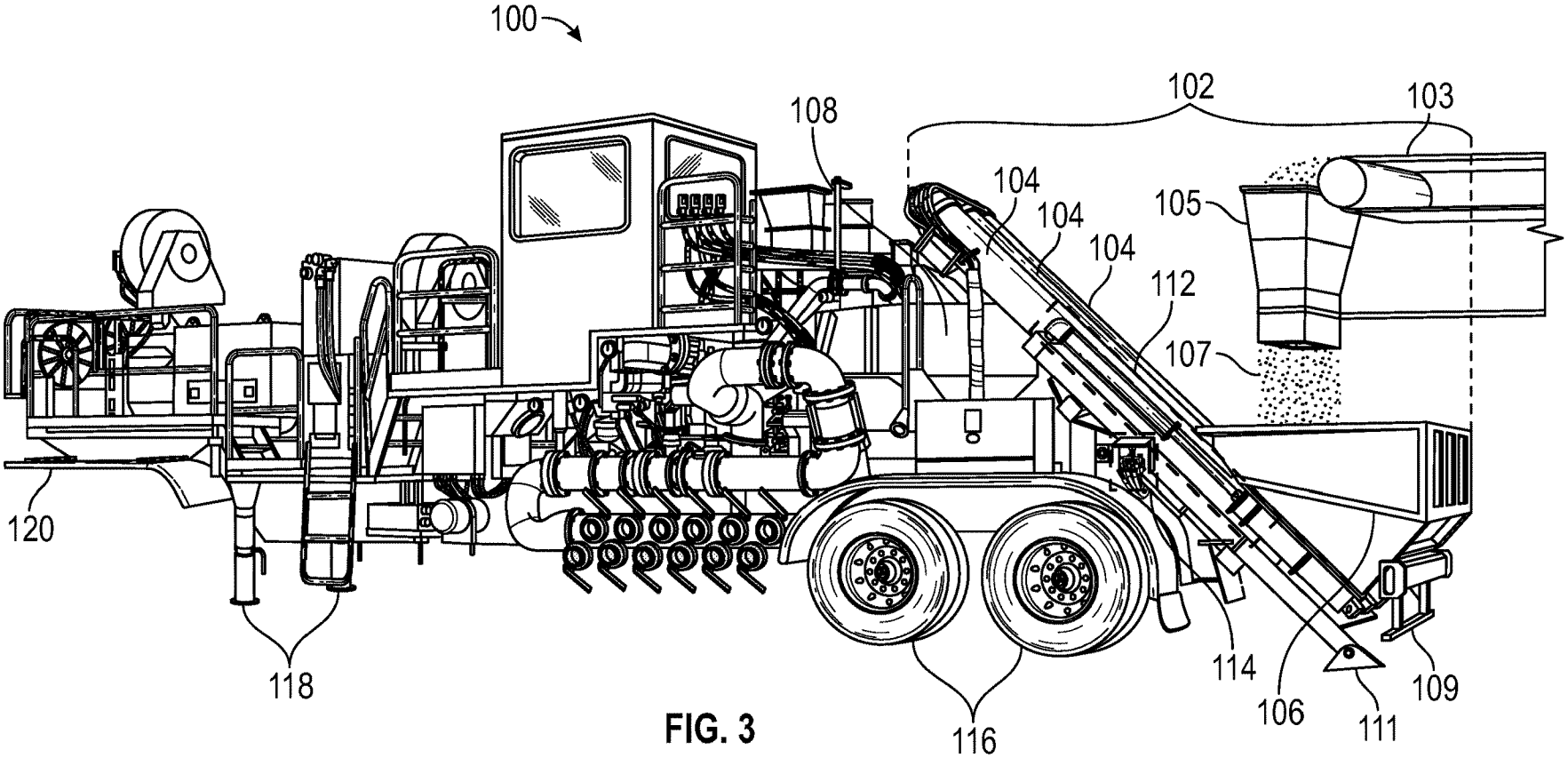
FIG. 3 is a side perspective view of a blender system with an auger and hopper assembly in a deployed position according to certain embodiments.

For example, the blender unit 28 can be positioned on a trailer, such as the exemplary trailer illustrated in FIG. 2 and FIG. 3. Thus, the blender unit 28 and various other components can comprise a blender system 100. The blender system 100 includes an auger and hopper assembly 102, which includes a hopper 106. The auger and hopper assembly 102 is capable of moving between a stowed position (FIG. 2) and a deployed position (FIG. 3). In embodiments, the stowed position is elevationally above the deployed position, and the auger and hopper assembly 102 can move between the two positions via an angled track 112, which is positioned between the augers 104 and the blender tub 108. Looking at FIG. 2 and FIG. 3 together, the auger and hopper assembly 102 can begin in the stowed position as shown in FIG. 2. The auger and hopper assembly 102 can be directed in the direction of the arrows 105 to reach its deployed position as shown in FIG. 3. A landing gear 111 can bear the weight of the hopper 106 when the auger and hopper assembly 102 is in the deployed position. In embodiments, the landing gear 111 comprises two support legs, one on each side of the hopper 106. A bumper 109 or safety guard can also be included to keep people or equipment from making contact with the exposed auger bearings.

The auger and hopper assembly 102 is typically placed in the stowed position during transport of the blender system 100. A hitch or other suitable coupling mechanism 120 can be provided on one end of the blender system 100 to facilitate transport. The blending system 100 can be towed to a desired location at an appropriate distance from a fracking site. In the illustrated embodiment, the blending system includes unpowered wheels 116 to facilitate towing and weight-bearing legs 118 to support the blending system 100 when the towing vehicle disengages. The legs 118 can be independently adjusted to allow an operator to level the blending system, or otherwise achieve a desired tilt, even while accounting for uneven ground. Although not required for operations, the blending system 100 can be isolated, i.e. no longer connected to a towing vehicle, due to space constraints in the field. Once in position, the blending system 100 is connected to micro-grid 54 or otherwise supplied with main electrical power. The main electrical unit powers the blender unit 28, enabling it to draw fluid onboard through a suction manifold and pump, and blend the proppant and fluid/additive mixture to form a fracturing slurry, which is then boosted to a fracturing pump system 36 through a discharge pump, as described more thoroughly with respect to FIG. 1.

In other words, main power is not provided to the blender system 100 until after the blender system 100 is initially staged. In some cases, it may take days from the time the equipment is staged before power is produced and directed to the blender system 100. Moreover, the blender system 100 is typically staged early in the process—before fracking pumps, iron, and sand equipment are positioned—so delays to staging the blender system 100 hold up other portions of the process. Further still, it is very difficult and dangerous to move equipment after power cables have been connected.

Main power is typically generated by diesel engines for diesel equipment or by an electric generator for electrically powered equipment. For electrically powered equipment, an electric generator may not arrive onsite until after the blender system 100 is in place, or the electric generator may be onsite, but not generating power until after the blender system 100 is in place. Thus, if positioning the auger and hopper assembly 102 of the blender system 100 rely exclusively on the main power, the auger and hopper assembly 102 cannot be raised or lowered into an ideal placement until the main electrical power is active and connected. In the event of a misalignment, the entire blender system 100 would need to be repositioned, which would be costly, time consuming, difficult, and sometimes dangerous.

Put another way, without an independent power supply for the auger and hopper assembly 102, the blender system 100 can be maneuvered into an incorrect position, but it will not be known that the hopper 106 is improperly aligned with the proppant feed until the entire blender system 100 is connected to a power supply, such as, for example, the micro-grid 54 discussed above. Once the misalignment is detected, the entire blender system 100 would have to be disconnected from the power supply in order to reposition the blender system 100. This process may even have to be iterated multiple times given the difficulty of estimating whether the hopper 106 will be properly aligned with the conveyor belt (or appropriate proppant feed) when in the deployed position. These iterations may involve disconnecting the main power and moving other equipment to allow for maneuvering the blender system 100. This can cause hours or days of downtime. Thus prior to being transported to a wellsite, the auger and hopper assembly 102 are put into a stowed position, and remain in that position, until the main power is online. The main power stays online until the fracturing job is completed. Usually the deployed position of the auger and hopper assembly 102 is difficult to predict accurately because the equipment is initially positioned with the auger and hopper assembly 102 in the stowed position.

After the fracturing job is completed, a rig down process occurs in which equipment is removed from the site. The main power is disconnected before the blender system 100 is moved. If the auger and hopper assembly 102 is in the deployed position, the blender system 100 cannot be moved. That is, if operators disconnected the main power from the blender system 100 without stowing the auger and hopper assembly 102, and there was no independent power supply to the auger and hopper assembly 102, then the blender system 100 would be unmovable until main power was reconnected to the blender system for the sole purpose of stowing the auger and hopper assembly 102. This problem, among others, is addressed by the claimed embodiments, which allow for the auger and hopper assembly 102 to move between the stowed position and deployed position without the blender system 100 needing to be connected to the main power source.

Still referring to FIG. 2 and FIG. 3, the blender system 100 is mounted on a trailer. In this example, the blender is a fracturing blender having a capability of supplying 130 bbl/min, and it is designed to mix slurries for fracturing treatments. The slurries, which can be used in hydraulic fracturing, can also include water or other fluids. In various embodiments, the blender system 100 can be skid, truck, or trailer mounted, and can be used on or off-shore. The auger and hopper assembly 102 includes one or more obliquely angled augers 104 that lift proppant from an attached hopper 106, and deliver the proppant to a blender tub 108 as shown. The system is capable of handling a wide array of tasks associated with complex fracturing operations in harsh oil-field conditions; and is operable in temperature ranges of −4° F. (−20° C.) to 115° F. (46° C.). Embodiments of the unit include 10 inch diameter pipe and a total power rating of 1,400 BHP (minimum). In one example, the system pumps inhibited acid.

The blender system 100 includes an independently powered auger and hopper positioning system to raise and lower the auger and hopper assembly 102 prior to setting up the main electrical power. The positioning system controls 114 are used to adjust the position of the auger and hopper assembly 102. In embodiments, the power supply comprises a dedicated electric 12 VDC power supply. In one example, the positioning system includes one or more actuators for positioning the auger and hopper assembly 102. In embodiments, the actuators are powered by a 12 VDC power supply. The power supply provides power for a hydraulic pump. In embodiments, the hopper power supply is not in communication with the main electrical power. In embodiments, the battery powering the auger and hopper control system is charged by the main power supply when the main power is on. In an embodiment, the actuators include one or more electrical motors and associated linkages, where the motors provide hydraulic power to drive the hydraulic cylinders 5 (FIG. 4 and FIG. 5) and linkages with sufficient force for positioning the auger/hopper into a designated position and/or orientation. In FIG. 5, the cylinder 5 is in a retracted configuration, whereas in FIG. 4 the cylinder 5 is in an extended configuration. Alternatively, the actuators are hydraulically powered with hydraulic fluid pressurized by pumps that are powered by the 12 VDC power source.

As indicated above, when setting up a hydraulic fracturing site it is important to position the sand delivery system and the blender so that the sand enters the blender hopper 106 in roughly the center of the hopper. However, it can be difficult to visualize exactly where the auger and hopper assembly 102 will be in the deployed position. Compounding this problem is that, in various embodiments, there are two blenders. One serves as a primary blender, and the other serves as a back-up blender. The proppant feed—the chute on a sand conveyor belt, for example—needs to be able to reach both blenders, while leaving some room between the blenders for personnel and equipment, such as fluid hoses, chemical hoses, and other tools.

Embodiments of the method and system described herein position the blender system 100, lower the auger/hopper assembly 102, and align the hopper 106 with the sand conveyer and other sand equipment. The steps of aligning and positioning described herein are performed without power from the main power supply. In embodiments, the hydraulic lines for powering the auger/blender actuator are isolated from other hydraulic lines that deliver hydraulic fluid to different services or circuits, such as cooling fans, blower motors, chemical pumps, the blender's suction pump, valve actuators, and the auger motors for rotating the auger blade. Optionally, the hydraulic lines that power the auger/hopper actuator can share a same hydraulic tank as other hydraulic systems.

Figure 4:
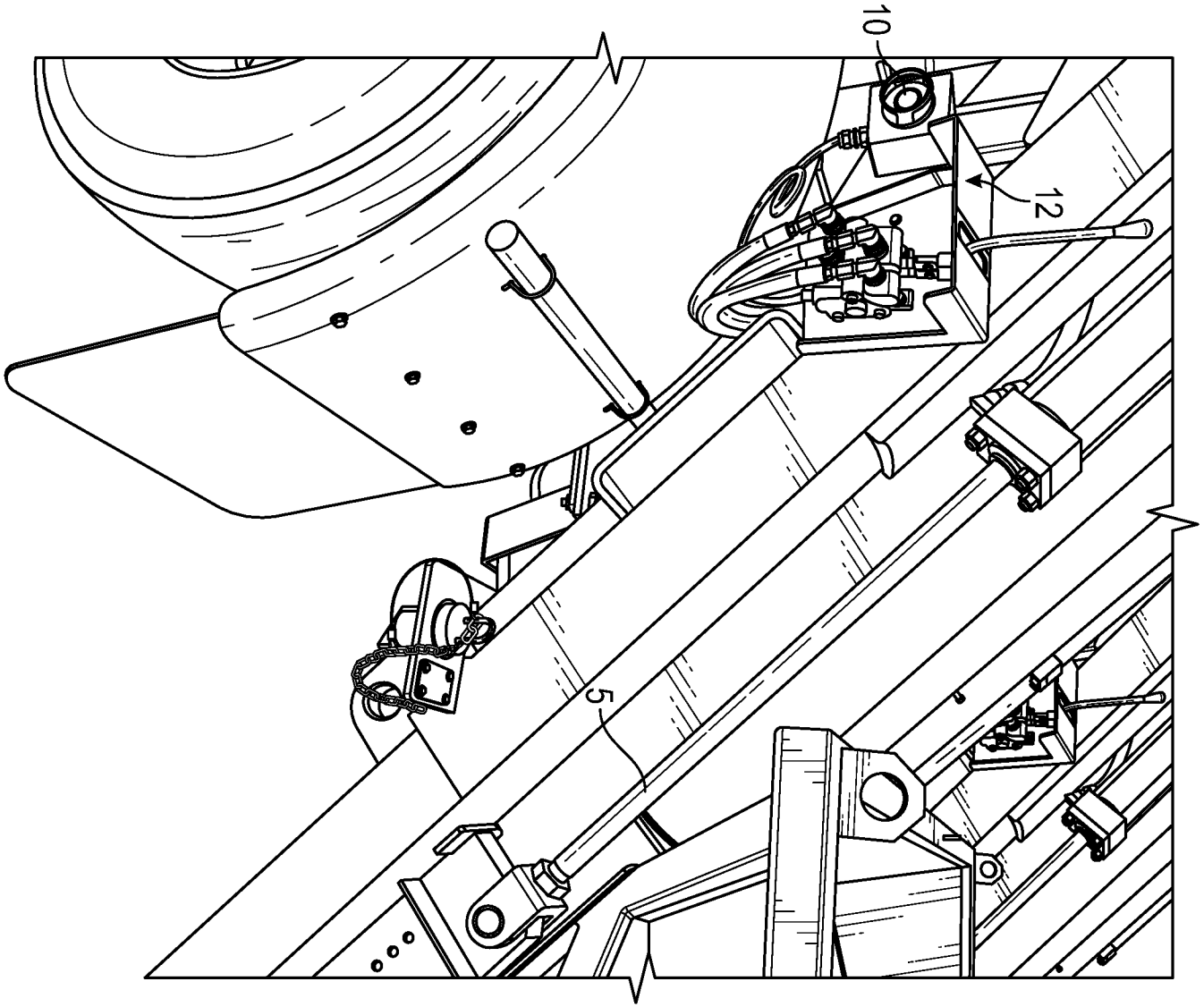
FIG. 4 is a view of a portion of a blender system with an auger and hopper assembly in a deployed position according to certain embodiments.
Figure 5:
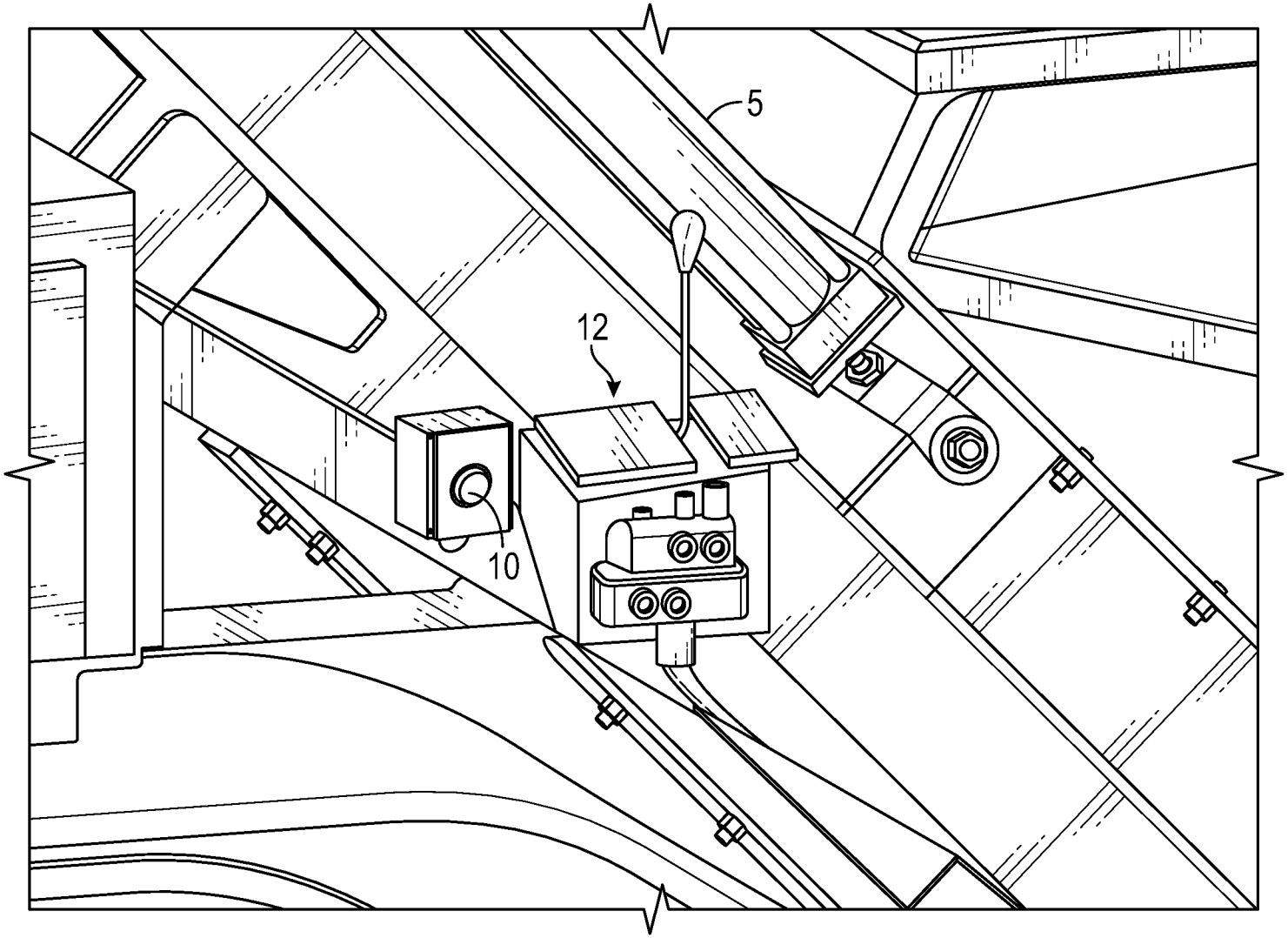
FIG. 5 is a view of a portion of a blender system with an auger and hopper assembly in a stowed position according to certain embodiments.
Figure 6:
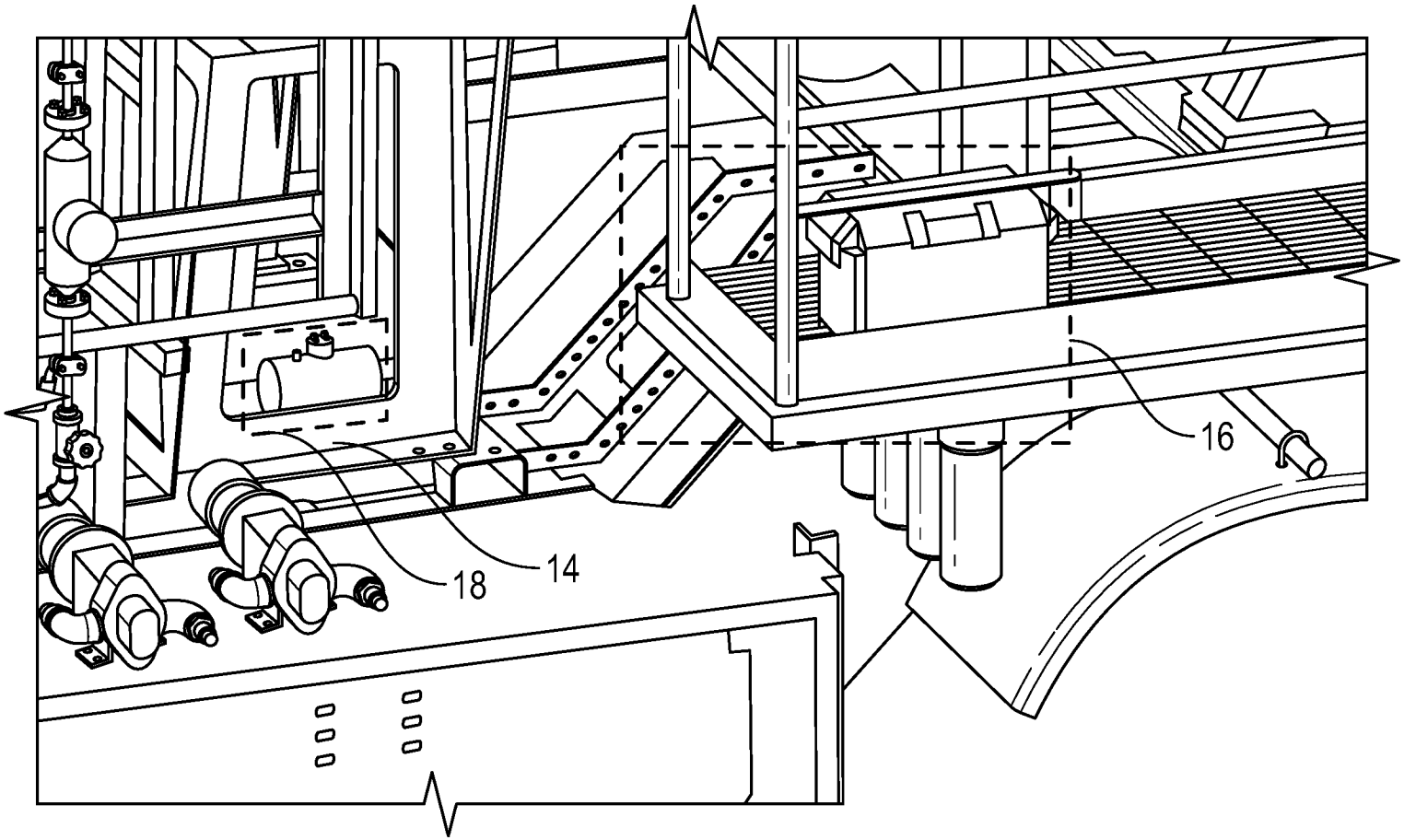
FIG. 6 is a view of a portion of a blender system according to certain embodiments.
Figure 7:
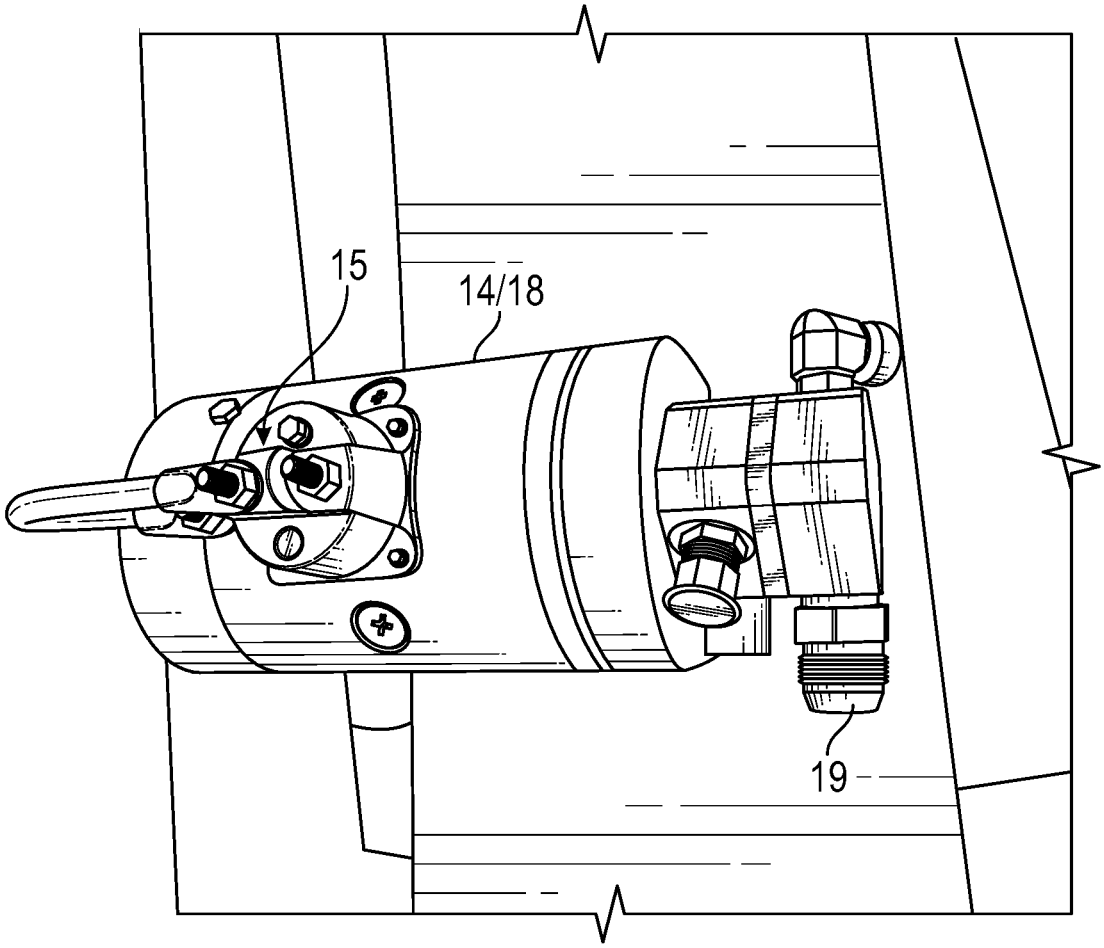
FIG. 7 is a view of a pump and motor assembly according to certain embodiments.

Referring now to FIG. 4, shown in a side perspective view is a portion of the auger and hopper assembly 102. A start button 10 can selectively energize a motor that drives a hydraulic pump, where the pump pressurizes hydraulic fluid for powering the actuators. Then the auger and hopper assembly 102 can be raised or lowered using a three-position valve 12. The three-position valve 12 can include positions for stowed, deployed, and closed. In certain embodiments, the stowed position can be labeled "up," and the deployed position can be labeled "down" on the valve 12. In the example of FIG. 4, the valve 12 is disposed in a hydraulic circuit and between the hydraulic pump and the actuators. Shown in perspective view in FIG. 6 is an example of a hydraulic pump 14 for pressurizing the hydraulic fluid used to actuate cylinder 5 (FIG. 5) into an extended position for selectively positioning the auger and hopper assembly 102. Further illustrated in FIG. 6 is a battery 16 that selectively provides electrical power to a motor 18 shown schematically coupled with the pump 14. The motor 18 and pump 14 are provided in a single unit in certain embodiments. FIG. 7 provides another view of this unit. Electrical connections 15 are provided to connect the motor 18 to the battery 16. Hydraulic connections 19 to the pump 14 are provided as well.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. An auger and hopper assembly for use in a hydraulic fracturing operation comprising:

a hopper with an upper opening to receive proppant;

an auger positioned outside the hopper and connected to the hopper, the auger including:

an auger inlet to receive proppant from the hopper, an auger outlet to release proppant from the auger, and an auger blade configured to transport proppant from the auger inlet to the auger outlet; and a connection to an independent auger and hopper power supply, the independent auger and hopper power supply powering one or more actuators that communicate with the auger and hopper assembly to move the auger and hopper assembly from a stowed position to a deployed position.

2. The auger and hopper assembly of claim 1, wherein the independent auger and hopper power supply comprises a battery.

3. The auger and hopper assembly of claim 2, wherein the battery comprises a 12 volt direct current battery.

4. The auger and hopper assembly of claim 2, wherein the battery is connected to a main power supply, the main power supply providing power to a blender unit configured to blend proppant with a fluid to produce a fracturing slurry.

5. The auger and hopper assembly of claim 4, wherein the main power supply recharges the battery when the main power supply provides power to the blender unit.

6. The auger and hopper assembly of claim 5, wherein the main power supply comprises an electric generator powered by combustion of a fuel in a turbine.

7. The auger and hopper assembly of claim 2, wherein an electric generator recharges the battery without independently powering the one or more actuators.

8. The auger and hopper assembly of claim 1, wherein the deployed position of the auger and hopper assembly aligns the upper opening of the hopper with a chute associated with a sand conveyor.

* * * * *